US010343867B2

(12) United States Patent
Kurisu et al.

(10) Patent No.: US 10,343,867 B2
(45) Date of Patent: Jul. 9, 2019

(54) STEEL SHEET SHAPE CONTROL METHOD AND STEEL SHEET SHAPE CONTROL APPARATUS

(71) Applicant: NIPPON STEEL & SUMITOMO METAL CORPORATION, Tokyo (JP)

(72) Inventors: Yasushi Kurisu, Tokyo (JP); Yoshihiro Yamada, Tokyo (JP); Futoshi Nishimura, Tokyo (JP); Katsuya Kojima, Tokyo (JP); Junya Takahashi, Tokyo (JP); Masaaki Omodaka, Tokyo (JP); Masafumi Matsumoto, Tokyo (JP); Hiroyuki Tanaka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 266 days.

(21) Appl. No.: 15/375,680

(22) Filed: Dec. 12, 2016

(65) Prior Publication Data

US 2017/0088381 A1 Mar. 30, 2017

Related U.S. Application Data

(62) Division of application No. 14/342,653, filed as application No. PCT/JP2013/062752 on May 2, 2013, now Pat. No. 9,551,056.

(30) Foreign Application Priority Data

May 10, 2012 (JP) ..... 2012-108500

(51) Int. Cl.
*C23C 2/24* (2006.01)
*B65H 23/032* (2006.01)
(Continued)

(52) U.S. Cl.
CPC ..... *B65H 23/032* (2013.01); *B65H 23/0324* (2013.01); *C23C 2/003* (2013.01);
(Continued)

(58) Field of Classification Search
CPC ..... C23C 16/45523; C23C 16/44; C23C 16/45527
See application file for complete search history.

(56) References Cited

U.S. PATENT DOCUMENTS 3,784,072 A * 1/1974 Armstrong ..... B21B 38/02 226/1
6,471,153 B1 * 10/2002 Kimura ..... B21B 37/007 226/15
(Continued)

FOREIGN PATENT DOCUMENTS

EP 0855450 A1 7/1998
EP 1 063 314 A1 12/2000
(Continued)

OTHER PUBLICATIONS

Chinese Office Action and Search Report dated Dec. 2, 2014, for Chinese Application No. 201380001581.4 with an English translation of the Search Report.
(Continued)

*Primary Examiner* — David P Turocy
(74) *Attorney, Agent, or Firm* — Birch, Stewart, Kolasch & Birch, LLP

(57) ABSTRACT

A steel sheet shape control method includes, (A) setting a target correction shape of the steel sheet at a position of an electromagnet to a curved shape, (B) measuring a steel sheet shape when electromagnetic correction is performed, (C) calculating the steel sheet shape in a nozzle position based on the steel sheet shape, (D) repeating (B) and (C) by resetting the target correction shape to a curved shape having
(Continued)

a smaller amount of warp, (E) when the amount of warp of the steel sheet shape at the position of the nozzle is less than the upper limit value, (F) calculating vibration of the steel sheet at the position of the nozzle, and (G) adjusting a control gain of the electromagnet until amplitude of vibration is less than a second upper limit value when the amplitude of the vibration is equal to or more than the second upper limit value.

8 Claims, 7 Drawing Sheets

(51) Int. Cl.
*C23C 2/00* (2006.01)
*C23C 2/40* (2006.01)
*H01F 7/20* (2006.01)

(52) U.S. Cl.
CPC ..... *C23C 2/24* (2013.01); *C23C 2/40* (2013.01); *H01F 7/204* (2013.01); *B65H 2301/44332* (2013.01); *B65H 2553/22* (2013.01); *B65H 2553/24* (2013.01); *B65H 2555/42* (2013.01); *B65H 2701/173* (2013.01)

(56) References Cited

U.S. PATENT DOCUMENTS

| | | | | |
|---|---|---|---|---|
| 2003/0077397 | A1* | 4/2003 | Kabeya | C23C 2/003 427/431 |
| 2005/0115052 | A1 | 6/2005 | Takahashi et al. | |
| 2011/0217481 | A1* | 9/2011 | Ohara | C23C 2/003 427/547 |
| 2012/0067096 | A1* | 3/2012 | Molander | G05D 19/02 72/17.3 |

FOREIGN PATENT DOCUMENTS

| | | | | |
|---|---|---|---|---|
| EP | 1516939 | A1 | | 3/2005 |
| JP | 08-010847 | A | | 1/1996 |
| JP | 08010847 | A | * | 1/1996 |
| JP | 11-100651 | A | | 4/1999 |
| JP | 2002-285309 | A | | 10/2002 |
| JP | 2003-113460 | A | | 4/2003 |
| JP | 2003-293111 | A | | 10/2003 |
| JP | 2004-306142 | A | | 11/2004 |
| JP | 2007-296559 | A | | 11/2007 |
| JP | 5169089 | B2 | | 3/2013 |
| KR | 0146885 | B1 | | 11/1998 |
| KR | 2001-0055804 | A | | 7/2001 |
| KR | 10-2005-0014836 | A | | 2/2005 |
| WO | WO 2010/058837 | A1 | | 5/2010 |

OTHER PUBLICATIONS

International Search Report issued in PCT/JP2013/062752, dated Jul. 30, 2013.
Korean Notice of Allowance for Korean Application No. 10-2013-7033474, dated May 2, 2015, with an English translation.
PCT/ISA/237—Mailed on Jul. 30, 2013, issued in PCT/JP2013/062752.
Extended European Search Report, dated Dec. 7, 2015, for European Application No. 13787355.0.
Final Office Action dated May 27, 2016, issued in U.S. Appl. No. 14/342,653.
Non Final Office Action dated Feb. 1, 2016, issued in U.S. Appl. No. 14/342,653.
Notice of Allowance dated Sep. 15, 2016 issued in U.S. Appl. No. 14/342,653.

* cited by examiner

STEEL SHEET SHAPE CONTROL METHOD AND STEEL SHEET SHAPE CONTROL APPARATUS

This application is a Divisional of application Ser. No. 14/342,653, filed on Mar. 4, 2014, which is the National Stage of PCT International Application No. PCT/JP2013/062752, filed on May 2, 2013, which claims the benefit of priority under 35 U.S.C. § 119(a) to Patent Application No. JP 2012-108500, filed in Japan on May 10, 2012, all of which are hereby expressly incorporated by reference into the present application.

TECHNICAL FIELD

The present invention relates to a steel sheet shape control method and a steel sheet shape control apparatus for uniformizing coating thickness of a steel sheet in a continuous hot-dip metal coating apparatus.

BACKGROUND ART

When a hot-dip coated steel sheet is manufactured, first, a steel sheet is conveyed in a hot-dip coating bath, and coating is applied to front and rear surfaces of the sheet. Subsequently, gas such as air is sprayed from a wiping nozzle toward the front and the rear surfaces of the sheet while the coated steel sheet is drawn outside the hot-dip coating bath and is conveyed, the coating applied to the steel sheet is wiped, and thus, the coating thickness is adjusted and the hot-dip coated steel sheet is manufactured.

In order to manufacture the hot-dip coated steel sheet having uniform coating thickness, it is necessary to make intervals between the wiping nozzle and the front and the rear surfaces of the steel sheet be as constant as possible. Accordingly, in general, a support roll for pressing the steel sheet in a through-thickness direction and flattening the steel sheet shape is installed near an outlet side in the hot-dip coating bath. However, the steel sheet shape cannot be sufficiently corrected by only the support roll, and a warp (a so-called C warp, W warp, or the like) occurs in a transverse direction in the steel sheet which is drawn out to the outside of the hot-dip coating bath.

In the related art, an electromagnetic correction technology, which uses a plurality of electromagnets to correct the warp of the steel sheet, is used. For example, Patent Document 1 discloses that in order to uniformize coating thickness at both ends of a transverse direction of a steel sheet, electromagnetic correction is performed with reference to information of a position in the through-thickness direction of the both ends of the steel sheet which is measured by a separate sensor, and the warp of the both ends of the steel sheet is corrected in an appropriate direction.

Moreover, in Patent Document 2, a technology is disclosed which adjusts dispositions in the transverse direction of a plurality of electromagnets to correspond to a change of a sheet width or meandering of a steel sheet when C warp of the steel sheet is corrected by electromagnets. Moreover, in Patent Document 3, similarly, in order to correspond to the change of the steel width or meandering of the steel sheet, a technology, which moves the electromagnets in the transverse direction, is disclosed.

In addition, in Patent Document 4, a steel sheet shape correction apparatus is disclosed which includes a control unit which automatically adjusts a pass line by moving a pair of support rolls corresponding to the output values of electromagnets on the front side and the rear side of a steel sheet.

Moreover, in Patent Document 5, an apparatus is disclosed in which a plurality of sensors and electromagnets are installed to be opposite to a strip, a position of the strip is detected by a sensor installed in the electromagnet and a sensor installed to be separated from the electromagnet, for example, installed at a position of a wiping nozzle or the like, two signals of the sensors are fed back to currents of the electromagnet, and shape correction of the strip and vibration control of the strip are performed at the position of the wiping nozzle separated from the electromagnet, or the like.

In addition, in Patent Document 6, a continuous hot-dip metal coating method is disclosed in which when a hot-dip metal coating is performed on a metal band by a continuous hot-dip metal coating line which includes a gas wiping nozzle adjusting a coating thickness, a non-contact control apparatus controlling a shape position of a metal band of the gas wiping nozzle portion in a non-contact manner, and a correction roll in a bath correcting the shape of the metal band of the gas wiping nozzle portion in a hot-dip metal coating bath, a determination is performed of whether or not the shape position of the metal band of the gas wiping nozzle portion can be controlled by only the non-contact control apparatus based on at least a thickness of the metal band to be hot-dip metal coated. When the shape position of the metal band of the gas wiping nozzle portion can be controlled by only the non-contact control apparatus, the shape position of the metal band is controlled by only the non-contact control apparatus to make the correction roll in the bath not contact the metal band. When the control of the shape position of the metal band is made difficult by only the non-contact control apparatus, the shape position of the metal band is controlled by only the correction roll in the bath or by using both the correction roll in the bath and the non-contact control apparatus.

PRIOR ART DOCUMENTS

Patent Documents (Patent Document 1) Japanese Unexamined Patent Application, First Publication No. 2007-296559
(Patent Document 2) Japanese Unexamined Patent Application, First Publication No. 2004-306142
(Patent Document 3) Japanese Unexamined Patent Application, First Publication No. 2003-293111
(Patent Document 4) Japanese Unexamined Patent Application, First Publication No. 2003-113460
(Patent Document 5) Japanese Unexamined Patent Application, First Publication No. H08-010847
(Patent Document 6) Japanese Patent No. 5169089

DISCLOSURE OF INVENTION

Problems to be Solved by the Invention

As described above, as the method for uniformizing the coating thickness with respect to the steel sheet, various methods are suggested. Mostly, the methods relate to improvement of an electromagnet equipment unit.

When the shape in the transverse direction of the steel sheet is optimized considering the warp shape in the transverse direction of the steel sheet by the roll in the bath, if the warp occurs in the steel sheet at the position of the wiping nozzle even when the warp of the steel sheet is corrected at the position of the electromagnet, the coating thickness in the transverse direction of the steel sheet becomes not uniform. Moreover, since vibration occurs in the steel sheet which is lifted from the coating bath when the steel sheet is passed at a high speed, the coating thickness in a longitudinal direction of the steel sheet becomes not uniform.

Moreover, generally, there is an upper limit in frequency of vibration which can be suppressed by the electromagnet, and thus, it is not possible to suppress vibration having high frequency which is equal to or greater than a frequency response of the electromagnet. In addition, when the vibration of the steel sheet is suppressed by an electromagnetic force from the electromagnet, if the steel sheet is tightly held by the electromagnetic force, self-excited vibration having an electromagnetic force addition position as a node occurs in the steel sheet.

The present invention provides new and improved steel sheet shape control method and steel sheet shape control apparatus which appropriately suppress a warp and vibration of a steel sheet by optimizing the shape in a transverse direction of the steel sheet, and thus, can uniformize coating thickness in the transverse direction and a longitudinal direction of the steel sheet.

Means for Solving the Problems

According to a first aspect of the present invention, there is provided a steel sheet shape control method which, in a continuous hot-dip metal coating apparatus including a wiping nozzle disposed to be opposite to a steel sheet lifted from a coating bath and a plurality of pairs of electromagnets disposed along a transverse direction in both sides in a through-thickness direction of the steel sheet above the wiping nozzle, controls a shape in the transverse direction of the steel sheet by applying an electromagnetic force in the through-thickness direction with respect to the steel sheet by the electromagnets, the method including:

(A) setting a target correction shape in the transverse direction of the steel sheet at a position of the electromagnet to a curved shape by performing a first numerical analysis based on a passing condition of the steel sheet;

(B) measuring the shape in the transverse direction of the steel sheet at a predetermined position between the wiping nozzle and the electromagnet or measuring coating amount of the hot-dip metal with respect to the steel sheet at a subsequent stage of the electromagnet position when the steel sheet is conveyed in a state where the electromagnetic force is applied to the steel sheet by the electromagnet so that the shape in the transverse direction of the steel sheet at the position of the electromagnet is the curved shape set in (A);

(C) calculating the shape in the transverse direction of the steel sheet at the position of the wiping nozzle based on the shape or the coating amount measured in (B);

(D) repeating (B) and (C) by adjusting the target correction shape to a curved shape having an amount of warp different from the curved shape set in (A) by performing the first numerical analysis when the amount of warp of the shape calculated in (C) is equal to or more than a first upper limit value;

(E) measuring vibration in the through-thickness direction of the steel sheet at the predetermined position when the amount of warp of the shape calculated in (C) is less than the first upper limit value;

(F) calculating vibration in the through-thickness direction of the steel sheet at the position of the wiping nozzle by performing a second numerical analysis based on the vibration measured in (E); and (G) adjusting a control gain of the electromagnet by performing the second numerical analysis to make amplitude of the vibration calculated in (F) be less than a second upper limit value when the amplitude is equal to or more than the second upper limit value.

According to a second aspect of the present invention, in the first aspect, the continuous hot-dip metal coating apparatus may further include one or more first sensors which are disposed to be opposite to the steel sheet above the wiping nozzle and below the electromagnet, and measure the position in the through-thickness direction of the steel sheet, in (B), the shape in the transverse direction of the steel sheet at the position of the first sensor may be measured by the first sensor in the state where the electromagnetic force is applied to the steel sheet by the electromagnet, and in (E), the vibration in the through-thickness direction of the steel sheet at the position of the first sensor may be measured by the first sensor when the amount of warp of the shape calculated in (C) is less than the first upper limit value.

According to a third aspect of the present invention, in the first aspect or the second aspect, the continuous hot-dip metal coating apparatus may further include a plurality of pairs of second sensors which are disposed along the transverse direction in both sides in the through-thickness direction of the steel sheet at the position of the electromagnet, and measure the position in the through-thickness direction of the steel sheet, and (A) may include:

(A1) measuring the position in the through-thickness direction of the steel sheet at the position of the electromagnet by the second sensor when the steel sheet is conveyed in a state where the electromagnetic force is not applied by the electromagnet;

(A2) calculating a warp shape in the transverse direction of the steel sheet at the position of the electromagnet in the state where the electromagnetic force is not applied by the electromagnet, based on the position measured in (A1); and (A3) setting the target correction shape to a curved shape corresponding to the warp shape calculated in (A2).

According to a fourth aspect, in the third aspect, in (A3), the target correction shape may be set to a curved shape which is symmetrical in the through-thickness direction to the warp shape calculated in (A2).

According to a fifth aspect of the present invention, in the first aspect or the second aspect, in (A), the target correction shape in the transverse direction of the steel sheet by the electromagnet for each passing condition may be set using a predetermined database so that the amount of warp of the shape in the transverse direction of the steel sheet at the position of the electromagnet is within a predetermined range and the amount of warp of the shape in the transverse direction of the steel sheet at the position of the wiping nozzle is less than the first upper limit value in the state where the electromagnetic force is applied.

According to a sixth aspect of the present invention, in any one of the first to the fifth aspects, in (D), disposition of a roll provided in the coating bath may be adjusted so that the amount of warp of the shape in the transverse direction of the steel sheet at the position of the electromagnet is within a predetermined range and the amount of warp of the shape in the transverse direction of the steel sheet at the position of the wiping nozzle is less than the first upper limit value in the state where the electromagnetic force is applied.

According to a seventh aspect of the present invention, in the sixth aspect, the roll may include a sink roll which converts the conveyed direction of the steel sheet to a vertical upper side, and at least one support roll which is provided above the sink roll and contacts the steel sheet conveyed to the vertical upper side, and in (D), a pushing-in amount of the steel sheet by the support roll may be adjusted so that the amount of warp of the shape in the transverse direction of the steel sheet at the position of the electromagnet is within a predetermined range and the amount of warp of the shape in the transverse direction of the steel sheet at the position of the wiping nozzle is less than the first upper limit value in the state where the electromagnetic force is applied.

According to an eighth aspect of the present invention, in any one of the first to the seventh aspects, in (D), (B) and (C) may be repeated by resetting the target correction shape to a curved shape having the amount of warp smaller than that of the curved shape set in (A) when the amount of warp of the shape calculated in (C) is equal to or more than the first upper limit value or when the amount of warp of the warp shape in the transverse direction of the steel sheet at the position of the electromagnet is outside a predetermined range.

According to a ninth aspect of the present invention, in any one of the first to the eighth aspects, the first numerical analysis may be performed using a virtual roll.

According to a tenth aspect of the present invention, in any one of the first to the ninth aspects, the amplitude of the steel sheet may be calculated using a spring constant in the second numerical analysis.

According to an eleventh aspect of the present invention, in any one of the first to the tenth aspects, a control system of the electromagnet may be a PID control, in (G), the amplitude may be controlled by decreasing a proportional gain of a proportional operation of the PID control as the control gain.

According to a twelfth aspect of the present invention, in any one of the fifth to the eleventh aspects, a range of the amount of warp of the shape in the transverse direction of the steel sheet may be 2.0 mm or more.

According to a thirteenth aspect of the present invention, in any one of the first to the twelfth aspects, the first upper limit value may be 1.0 mm, and the second upper limit value may be 2.0 mm.

According to a fourteenth aspect of the present invention, there is provided a steel sheet shape control apparatus which is provided in a continuous hot-dip metal coating apparatus including a wiping nozzle disposed to be opposite to a steel sheet lifted from a coating bath, and which controls a shape in a transverse direction of the steel sheet by applying an electromagnetic force in a through-thickness direction with respect to the steel sheet, the apparatus including:

a plurality of pairs of electromagnets which are disposed along the transverse direction in both sides in the through-thickness direction of the steel sheet above the wiping nozzle; and a control device which controls the electromagnet, wherein the control device, (A) sets a target correction shape in the transverse direction of the steel sheet at a position of the electromagnet to a curved shape by performing a first numerical analysis based on a passing condition of the steel sheet, (B) measures the shape in the transverse direction of the steel sheet at a predetermined position between the wiping nozzle and the electromagnet or measures coating amount of the hot-dip metal with respect to the steel sheet at the subsequent stage of the electromagnet position when the steel sheet is conveyed in a state where the electromagnetic force is applied to the steel sheet by the electromagnet so that the shape in the transverse direction of the steel sheet at the position of the electromagnet is the curved shape set in (A), (C) calculates the shape in the transverse direction of the steel sheet at the position of the wiping nozzle based on the shape or the coating amount measured in (B), (D) repeats (B) and (C) by adjusting the target correction shape to a curved shape having an amount of warp different from the curved shape set in (A) by performing the first numerical analysis when the amount of warp of the shape calculated in (C) is equal to or more than a first upper limit value, (E) measures vibration in the through-thickness direction of the steel sheet at the predetermined position when the amount of warp of the shape calculated in (C) is less than the first upper limit value, (F) calculates vibration in the through-thickness direction of the steel sheet at the position of the wiping nozzle by performing a second numerical analysis based on the vibration measured in (E), and (G) adjusts a control gain of the electromagnet by performing the second numerical analysis to make amplitude of the vibration calculated in (F) be less than a second upper limit value when the amplitude is equal to or more than the second upper limit value.

According to a fifteenth aspect of the present invention, in the fourteenth aspect, the steel sheet shape control apparatus may further include one or more first sensors which are disposed to be opposite to the steel sheet above the wiping nozzle and below the electromagnet, and measure the position in the through-thickness direction of the steel sheet, the control device in (B), may measure the shape in the transverse direction of the steel sheet at the position of the first sensor by the first sensor in the state where the electromagnetic force is applied to the steel sheet by the electromagnet, and in (E), may measure vibration in the through-thickness direction of the steel sheet at the position of the first sensor by the first sensor when the amount of warp of the shape calculated in (C) is less than the first upper limit value.

According to a sixteenth aspect of the present invention, in the fourteenth or the fifteenth aspect, the steel sheet shape control apparatus may further include a plurality of pairs of second sensors which are disposed along the transverse direction in both sides in the through-thickness direction of the steel sheet at the position of the electromagnet, and measure the position in the through-thickness direction of the steel sheet, the control device, when the target correction shape is set in (A), (A1) may measure the position in the through-thickness direction of the steel sheet at the position of the electromagnet by the second sensor when the steel sheet is conveyed in a state where the electromagnetic force is not applied by the electromagnet, (A2) may calculate a warp shape in the transverse direction of the steel sheet at the position of the electromagnet in the state where the electromagnetic force is not applied by the electromagnet, based on the position measured in (A1), and (A3) may set the target correction shape to a curved shape corresponding to the warp shape calculated in (A2).

According to a seventeenth aspect of the present invention, in the sixteenth aspect, in (A3), the target correction shape may be set to a curved shape which is symmetrical in the through-thickness direction to the warp shape calculated in (A2).

According to an eighteenth aspect of the present invention, in the fourteenth or the fifteenth aspect, the control device, when the target correction shape is set in (A), may set the target correction shape in the transverse direction of the steel sheet by the electromagnet for each passing condition using a predetermined database so that the amount of warp of the shape in the transverse direction of the steel sheet at the position of the electromagnet is within a predetermined range and the amount of warp of the shape in the transverse direction of the steel sheet at the position of the wiping nozzle is less than the first upper limit value in the state where the electromagnetic force is applied.

According to a nineteenth aspect of the present invention, in any one of the fourteenth to the eighteenth aspects, the control device, in (D), may adjust disposition of a roll provided in the coating bath so that the amount of warp of the shape in the transverse direction of the steel sheet at the position of the electromagnet is within a predetermined range and the amount of warp of the shape in the transverse direction of the steel sheet at the position of the wiping nozzle is less than the first upper limit value in the state where the electromagnetic force is applied.

According to a twentieth aspect of the present invention, in the nineteenth aspect, the roll may include a sink roll which converts the conveyed direction of the steel sheet to a vertical upper side, and at least one support roll which is provided above the sink roll and contacts the steel sheet conveyed to the vertical upper side, and the control device, in (D), may adjust a pushing-in amount of the steel sheet by the support roll so that the amount of warp of the shape in the transverse direction of the steel sheet at the position of the electromagnet is within a predetermined range and the amount of warp of the shape in the transverse direction of the steel sheet at the position of the wiping nozzle is less than the first upper limit value in the state where the electromagnetic force is applied.

According to a twenty-first aspect of the present invention, in any one of the fourteenth to the twentieth aspects, the control device, in (D), may repeat (B) and (C) by resetting the target correction shape to a curved shape having the amount of warp smaller than that of the curved shape set in (A) when the amount of warp of the shape calculated in (C) is equal to or more than the first upper limit value or when the amount of warp of the warp shape in the transverse direction of the steel sheet at the position of the electromagnet is outside a predetermined range.

According to a twenty-second aspect of the present invention, in any one of the fourteenth to the twenty-first aspects, the first numerical analysis may be performed using a virtual roll.

According to a twenty-third aspect of the present invention, in any one of the fourteenth to the twenty-second aspects, the amplitude of the steel sheet may be calculated using a spring constant in the second numerical analysis.

According to a twenty-fourth aspect of the present invention, in any one of the fourteenth to the twenty-third aspects, a control system of the electromagnet may be a PID control, and in (G), the amplitude may be controlled by decreasing a proportional gain of a proportional operation of the PID control as the control gain.

According to a twenty-fifth aspect of the present invention, in any one of the eighteenth to the twenty-fourth aspects, a range of the amount of warp of the shape in the transverse direction of the steel sheet at the position of the electromagnet may be 2.0 mm or more.

According to a twenty-sixth aspect of the present invention, in any one of the fourteenth to the twenty-fifth aspects, the first upper limit value may be 1.0 mm, and the second upper limit value may be 2.0 mm.

According to the above-described configurations, by correcting the shape in the transverse direction of the steel sheet at the position of the electromagnet not to a flat shape but by positively correcting the shape to the curved shape, rigidity of the steel sheet passing between the wiping nozzle and the electromagnet is increased, and the amount of warp of the shape in the transverse direction of the steel sheet at the position of the wiping nozzle is controlled to be the first upper limit value or less. Accordingly, the shape in the transverse direction of the steel sheet at the position of the wiping nozzle can be controlled to be flat. Therefore, since hot dip coating can be uniformly wiped in the transverse direction of the steel sheet by the wiping nozzle, coating thickness in the transverse direction of the steel sheet can be uniformized.

Moreover, since the rigidity of the steel sheet at the position of the electromagnet can be increased by the above-described electromagnetic correction, vibration in the through-thickness direction of the steel sheet at the position of the wiping nozzle can be also suppressed. Accordingly, since the hot dip coating can be uniformly wiped in the longitudinal direction of the steel sheet by the wiping nozzle, the coating thickness in the longitudinal direction of the steel sheet can be uniformized.

Effects of the Invention

As described above, according to each aspect of the present invention, by optimizing the shape in the transverse direction of the steel sheet, the warp and the vibration of the steel sheet can be appropriately suppressed, and the coating thickness in the transverse direction and the longitudinal direction of the steel sheet can be uniformized.

PREFERRED EMBODIMENTS FOR CARRYING OUT THE INVENTION

Figure 1:
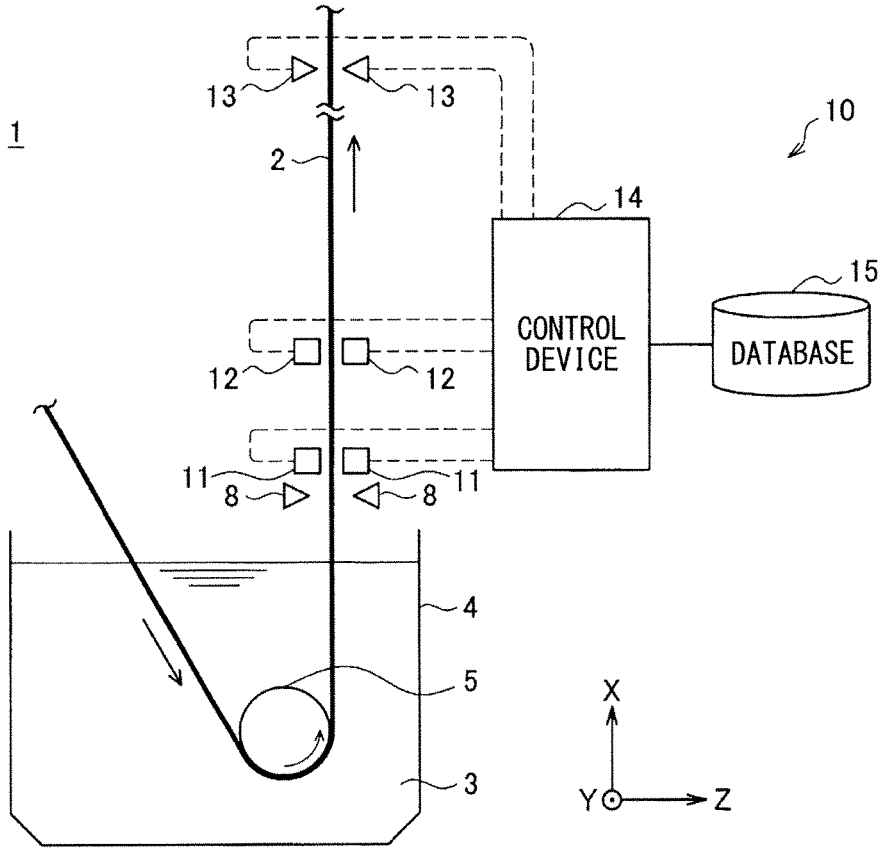
FIG. 1 is a schematic diagram showing a continuous hot-dip metal coating apparatus in accordance with a first preferred embodiment of the present invention.

Hereinafter, preferred embodiments of the present invention will be described in detail with reference to the accompanying drawings. In addition, in the present specification and drawings, the same reference numerals are attached to components having substantially the same functions, and the overlapped descriptions are omitted.

1. CONFIGURATION OF CONTINUOUS HOT-DIP METAL COATING APPARATUS

First, with reference to FIG. 1, an overall configuration of a continuous hot-dip metal coating apparatus, to which a steel sheet shape control apparatus in accordance with a first preferred embodiment of the present invention is applied, will be described. FIG. 1 is a schematic diagram showing a continuous hot-dip metal coating apparatus 1 in accordance with the first preferred embodiment of the present invention.

As shown in FIG. 1, the continuous hot-dip metal coating apparatus 1 is an apparatus for continuously coating a hot-dip metal to a surface of a belt-shaped steel sheet 2 by immersing the steel sheet 2 into a coating bath 3 filled with the hot-dip metal. The continuous hot-dip metal coating apparatus 1 includes a bath 4, a sink roll 5, a wiping nozzle 8, and a steel sheet shape control apparatus 10. The steel sheet shape control apparatus 10 includes a sensor 11, an electromagnet group 12 including a position sensor, a coating amount measurement device 13, a control device 14, and a database 15. In the continuous hot-dip metal coating apparatus 1, after the steel sheet 2 advances in an arrow direction and is conveyed in the coating bath 3 stored in the bath 4, the steel sheet 2 is drawn outside the coating bath 3.

The steel sheet 2 is a belt shaped metal material which is an object to be coated by the hot-dip metal. Moreover, in general, the hot-dip metal configuring the coating bath 3 includes an anti-corrosion metal such as zinc, lead-tin, and aluminum. However, the hot-dip metal may include other metals used as a coating metal. As the hot-dip coated steel sheet obtained by coating the steel sheet 2 with the hot-dip metal, a hot-dip zinc-coated steel sheet, a galvannealed steel sheet, or the like is representative. However, the hot-dip coated steel sheet may include other kinds of coated steel sheets. Hereinafter, an example is explained in which hot-dip zinc is used as the hot-dip metal configuring the coating bath 3, the hot-dip zinc is coated to the surface of the steel sheet 2, and the hot-dip zinc-coated steel sheet is manufactured.

The bath 4 stores the coating bath 3 which is configured of the hot-dip zinc (hot-dip metal). The sink roll 5, in which an axial direction is horizontal and a shaft is rotatably provided, is provided in the coating bath 3.

The sink roll 5 is an example of a roll (hereinafter, referred to as a roll in the bath) which is disposed in the coating bath 3 to guide the steel sheet 2, and is disposed at the lowest position of the coating bath 3. The sink roll 5 is rotated in a counterclockwise direction shown in FIG. 1 according to the convey of the steel sheet 2. The sink roll 5 converts the direction of the steel sheet 2, which is introduced toward an inclined lower side in the coating bath 3, to the upper side in a vertical direction (a transporting direction X).

Moreover, in the outside of the coating bath 3 immediately above the sink roll 5, the pair of wiping nozzles 8 and 8 is disposed such that the wiping nozzles 8 and 8 are opposite to each other above a bath surface of the coating bath 3 at a predetermined height. The wiping nozzles 8 and 8 are configured of gas wiping nozzles which spray gas (for example, air) onto the surfaces of the steel sheet 2 from both sides in a through-thickness direction Z. The wiping nozzles 8 and 8 wipe excess hot-dip zinc (hot-dip metal) by spraying gas on both surfaces of the steel sheet 2 which is lifted in the transporting direction X (vertical direction) from the coating bath 3. Accordingly, the coating thickness (coating amount) of the hot-dip zinc (hot-dip metal) with respect to the surfaces of the steel sheet 2 is adjusted.

Moreover, the steel sheet shape control apparatus 10 for controlling a shape in a transverse direction Y of the steel sheet 2 is provided above the wiping nozzles 8 and 8. The steel sheet shape control apparatus 10 functions as a shape correction apparatus for correcting a warp (so-called C warp, W warp, or the like) with respect to an axis in the transverse direction Y of the steel sheet 2. The steel sheet shape control apparatus 10 includes sensors 11 and 11, electromagnet groups 12 and 12, coating amount measurement devices 13 and 13, the control device 14, and the like which are shown in FIG. 1, and details thereof will be described below.

Moreover, other than the shown components, the continuous hot-dip metal coating apparatus 1 may include a top roll which supports the steel sheet 2 while converting the conveyed direction of the steel sheet 2 at the highest side outside the coating bath 3, an intermediate roll which supports the steel sheet 2 in the middle of reaching the top roll, or the like. In addition, an alloying furnace which performs an alloying treatment may be disposed downstream of the top roll.

Figure 2:
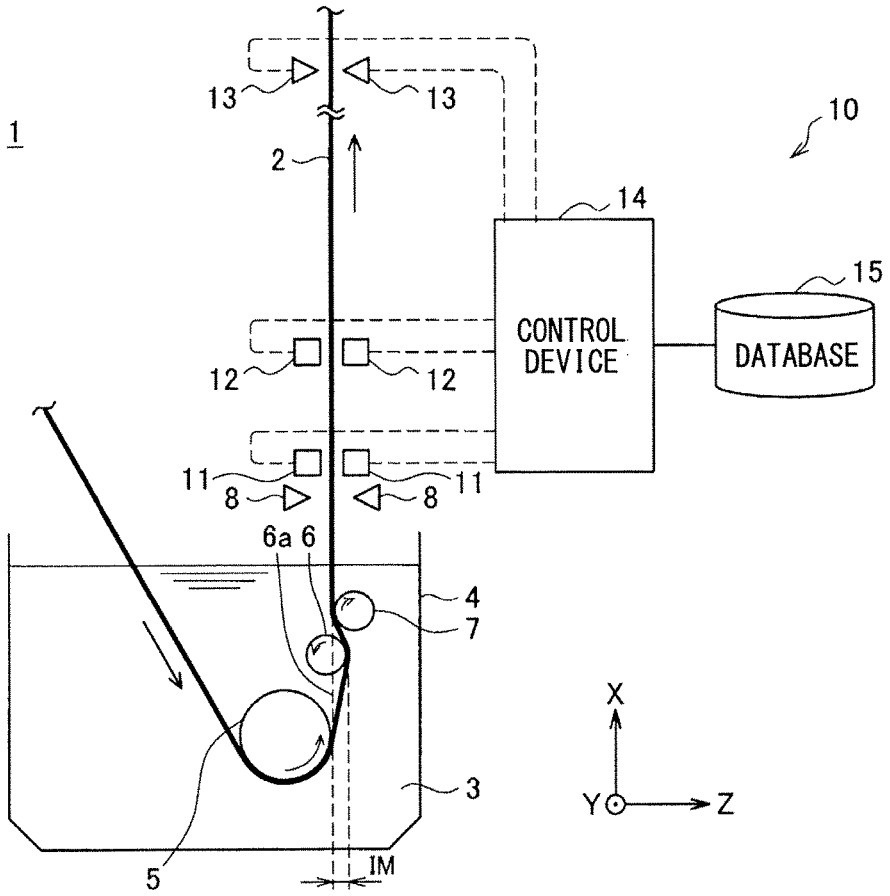
FIG. 2 is a schematic diagram showing a continuous hot-dip metal coating apparatus in accordance with a second preferred embodiment of the present invention.

Next, with reference to FIG. 2, an overall configuration of a continuous hot-dip metal coating apparatus 1 in accordance with a second preferred embodiment of the present invention will be described. FIG. 2 is a schematic diagram showing the continuous hot-dip metal coating apparatus 1 in accordance with the second preferred embodiment.

As shown in FIG. 2, the continuous hot-dip metal coating apparatus 1 in accordance with the second preferred embodiment is different from that of the above-described first preferred embodiment (refer to FIG. 1) in that a pair of support rolls 6 and 7 is provided in the coating bath 3, and other configurations are similar to each other.

Similar to the sink roll 5, the support rolls 6 and 7 are examples of rolls in the bath which guide the steel sheet 2, and are provided as a pair in the vicinity of an outlet side in the hot-dip coating bath 3 in the inclined upper side of the sink roll 5. Also in the support rolls 6 and 7, the axial directions are horizontal, and shafts are rotatably provided by bearings (not shown).

The support rolls 6 and 7 are disposed to insert the steel sheet 2, which is lifted in the vertical direction from the sink roll 5, from both sides in the through-thickness direction Z, and correct the shape of the steel sheet 2 by pressing the steel sheet 2 in the through-thickness direction Z. That is, the support rolls 6 and 7 contact the steel sheet 2, which is conveyed along a pass line 6*a* toward the transporting direction X (vertical upper side) from the sink roll 5, from both sides in the through-thickness direction Z. At this time, one support roll 6 is pushed in the through-thickness direction Z, and thus, the steel sheet 2 is conveyed meander between the support rolls 6 and 7, and the shape is corrected. At this time, a pushing-in amount of the support roll 6 is referred to as an Inter Mesh (IM). That is, the IM is a parameter which indicates the pushing-in amount in the through-thickness direction Z of the support roll 6 with respect to the steel sheet 2 which is conveyed on the pass line 6*a* along the transporting direction X.

Next, in a coating line of the continuous hot-dip metal coating apparatus 1 having the above-described configuration, a procedure which causes the steel sheet 2 to be conveyed will be described. Moreover, in the present preferred embodiment, the transporting direction X, the transverse direction Y, and the through-thickness direction Z shown in FIGS. 1 and 2 are orthogonal to one another.

As shown in FIGS. 1 and 2, in the continuous hot-dip metal coating apparatus 1, the steel sheet 2 is conveyed in the longitudinal direction (arrow direction) by a drive source (not shown), and enters in a predetermined inclination angle from the upper side to the lower side in the coating bath 3 through a snout (not shown). Moreover, the hot-dip zinc (hot-dip metal) is coated to the front and the rear surfaces of the steel sheet 2 by the entered steel sheet 2 conveyed in the coating bath 3. The steel sheet 2 which is conveyed in the coating bath 3 passes around the sink roll 5, the conveyed direction of the steel sheet is converted to the upper side in the vertical direction, and the steel sheet is drawn out above the coating bath 3. At this time, in the continuous hot-dip metal coating apparatus 1 having the configuration of FIG. 2, the shape of the steel sheet 2 is corrected when the steel sheet 2 conveyed to the upper side in the vertical direction in the coating bath 3 passes between the pair of support rolls 6 and 7.

Subsequently, the steel sheet 2 lifted from the coating bath 3 is conveyed along the transporting direction X (the upper side in the vertical direction) and passes between the wiping nozzles 8 and 8 disposed to be opposite to each other. At this time, air is sprayed by the wiping nozzles 8 and 8 from both sides in the through-thickness direction Z of the conveyed steel sheet 2, the coating of the hot-dip zinc (hot-dip metal) applied to both surfaces of the steel sheet 2 is blown off, and thus, the coating thickness is adjusted.

The steel sheet 2, which passes between the wiping nozzles 8 and 8, further is conveyed along the transporting direction X, and sequentially advances between the sensors 11 and 11, the electromagnet groups 12 and 12, and the coating amount measurement devices 13 and 13 which are disposed in both sides in the through-thickness direction Z of the steel sheet 2, and the shape in the transverse direction Y is corrected.

In this way, in the continuous hot-dip metal coating apparatus 1, the steel sheet 2 is continuously immersed into the coating bath 3 and is coated by the hot-dip zinc (hot-dip metal), and thus, the hot-dip zinc-coated steel sheet (hot-dip metal-coated steel sheet) having predetermined coating thickness is manufactured.

2. CONFIGURATION OF STEEL SHEET SHAPE CONTROL APPARATUS

Figure 3:
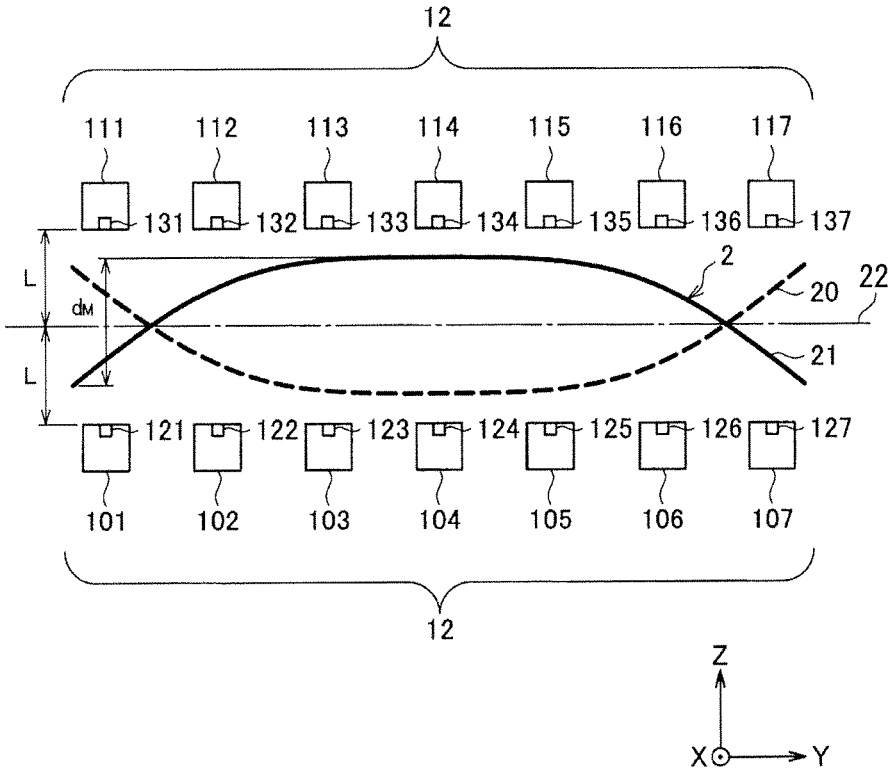
FIG. 3 is a horizontal cross-sectional diagram showing disposition of an electromagnet group of steel sheet shape control apparatuses in accordance with the first and second preferred embodiments of the present invention.

Next, with reference to FIGS. 1 to 3, a configuration of the steel sheet shape control apparatus 10 in accordance with the present preferred embodiment will be described in detail. FIG. 3 is a horizontal cross-sectional diagram showing disposition of electromagnet groups 12 and 12 of the steel sheet shape control apparatus 10 in accordance with the present preferred embodiment.

As shown in FIGS. 1 and 2, the steel sheet shape control apparatus 10 includes the plurality of pairs of sensors 11 and 11 which are disposed in both sides in the through-thickness direction Z of the steel sheet 2 which is drawn out from the wiping nozzles 8 and 8 and is conveyed in the transporting direction X, the plurality of pairs of electromagnet groups 12 and 12, the plurality of pairs of coating amount measurement devices 13 and 13, and the control device 14 which controls the sensors, the electromagnet groups, and measurement devices.

First, the sensor 11 will be described. The sensors 11 and 11 (corresponding to a "first sensor" of the present invention) are disposed to be opposite to both sides in the through-thickness direction Z of the steel sheet 2 above the wiping nozzles 8 and 8. Each sensor 11 has a function which measures the position in the transverse direction Y of the steel sheet 2 which is conveyed in the transporting direction X. In the present preferred embodiment, the sensor 11 is configured of a distance sensor which measures the distance up to the opposing steel sheet 2. For example, as the distance sensor, an eddy current displacement gauge may be used which measures the position in the through-thickness direction Z of the steel sheet 2 based on an impedance change of a sensor coil due to eddy current generated in the steel sheet 2.

Moreover, each sensor 11 is disposed to be separated by a predetermined distance from the steel sheet 2 so as not to contact the steel sheet 2 even when the steel sheet 2 conveyed in the transporting direction X vibrates in the through-thickness direction Z. The plurality of sensors 11 are disposed at a predetermined interval along the transverse direction Y of the steel sheet 2. Each of the plurality of sensors 11 measures the position of each portion in the transverse direction Y of the opposing steel sheet 2. Accordingly, the shape (warp shape with respect to the axis in the transverse direction Y) in the transverse direction Y of the steel sheet 2 can be measured using the sensors 11 and 11.

The sensors 11 and 11 are disposed at predetermined height positions above the wiping nozzles 8 and 8 and below electromagnet groups 12 and 12. In the present preferred embodiment, the sensors 11 and 11 are disposed in a row at the height positions in the vicinities of the wiping nozzles 8 and 8, and can measure the shape in the transverse direction Y of the steel sheet 2 in the vicinities of the wiping nozzles 8 and 8. However, the present invention is limited to the example, and the sensors 11 and 11 may be disposed in a row or a plurality of rows at any height positions as long as the sensors are positioned between the wiping nozzles 8 and 8 and the electromagnet groups 12 and 12. For example, the sensors may be disposed in the vicinities of the electromagnet groups 12 and 12, at intermediate positions between wiping nozzles 8 and 8 and the electromagnet groups 12 and 12, or the like, and may be disposed in two rows in the vicinities of the electromagnet groups 12 and 12 and in the vicinities of the wiping nozzles 8 and 8. Hereinafter, the height position in the transporting direction X, in which each of the sensors 11 and 11 is disposed, is referred to as a "sensor position".

In the present preferred embodiment, since the plurality of pairs of sensors 11 and 11 are disposed along the transverse direction Y in both sides in the through-thickness direction Z of the steel sheet 2, the shape in the transverse direction Y of the steel sheet 2 can be correctly measured. However, even when the sensors 11 are disposed on only one side in the through-thickness direction Z of the steel sheet 2, the shape in the transverse direction Y of the steel sheet 2 can be measured.

Next, the electromagnet group 12 will be described. The electromagnet groups 12 and 12 are disposed to be opposite to each other in both sides in the through-thickness direction Z of the steel sheet 2 above the sensors 11 and 11. The electromagnet groups 12 and 12 may be disposed at any height positions as long as the electromagnet groups are positioned above the wiping nozzles 8 and 8. Hereinafter, the height position in the transporting direction X, in which each of the electromagnet groups 12 and 12 is disposed, is referred to as an "electromagnet position".

As shown in FIG. 3, the electromagnet groups 12 and 12 are configured of a plurality of pairs of electromagnets 101 to 107 and 111 to 117 which are disposed along the transverse direction Y in both sides in the through-thickness direction Z of the steel sheet 2. The electromagnets 101 to 107 which configure one electromagnet group 12 and the electromagnets 111 to 117 which configure the other electromagnet group 12 are respectively disposed to be opposite to each other in the through-thickness direction Z. In the shown example, 7 electromagnets 101 to 107 and 7 electromagnets 111 to 117 are respectively disposed at a predetermined interval along the transverse direction Y in both sides of the steel sheet 2, and 7 pairs of electromagnets are disposed such that the electromagnets in each pair are opposite to each other. For example, the electromagnet 101 and the electromagnet 111 are disposed to be opposite to each other to interpose the steel sheet 2 in the through-thickness direction Z. Similarly, other electromagnets 102 to 107 and other electromagnets 112 to 117 are respectively disposed to be opposite to each other one-on-one.

In addition, position sensors 121 to 127 and 131 to 137 (corresponding to a "second sensor" of the present invention) are respectively installed in electromagnets 101 to 107 and 111 to 117. The sensors 121 to 127 and 131 to 137 are disposed along the transverse direction Y in both sides of the through-thickness direction Z of the steel sheet 2 at the electromagnet positions, and measure the positions in the through-thickness direction Z of the steel sheet 2 at the electromagnet positions. Moreover, in the example of FIG. 3, the electromagnets 101 to 107 and 111 to 117 and the position sensors 121 to 127 and 131 and 137 are disposed one-on-one. However, the disposition and the number of the installations of the position sensors 121 to 127 and 131 to 137 may be appropriately changed.

In the present preferred embodiment, the electromagnets 101 to 107 which configure the one electromagnet group 12 and the electromagnets 111 to 117 which configure the other electromagnet group 12 are separated from each other by a distance 2L in the through-thickness direction Z. That is, each of the electromagnets 101 to 107 and 111 to 117 is disposed to be separated by a predetermined distance L from the steel sheet 2 so as not to contact the steel sheet 2 even when the steel sheet 2 conveyed in the transporting direction X vibrates in the through-thickness direction Z. Moreover, as shown in FIG. 3, a straight line, which indicates an intermediate position which is positioned at an equal distance L in the through-thickness direction Z from both electromagnet groups 12 and 12, is referred to as a center line 22. The center line 22 corresponds to the axis in the transverse direction Y of the steel sheet 2.

If the steel sheet 2 is completely flat without being bent in the transverse direction Y at the electromagnet positions, a cross-section of the steel sheet 2 is positioned on the center line 22. However, in an actual operation, due to influence of the roll in the bath, the steel sheet 2 conveyed in the transporting direction X is curved in the through-thickness direction Z, and the warp (C warp, W warp, or the like) in the transverse direction Y may be generated. The example of FIG. 3 shows a state where the steel sheet 2 is C-warped by an amount of warp $d_M$. In addition, the amount of warp $d_M$ means a length in the through-thickness direction Z from the most protruded portion of the steel sheet to the most recessed portion of the steel sheet 2. The larger the amount of warp $d_M$, the more intense the warp of the steel sheet 2.

In the present preferred embodiment, the steel sheet shape control apparatus 10 is provided to cope with the warp, and the shape in the transverse direction Y of the steel sheet 2 can be corrected by applying an electromagnetic force to the steel sheet 2. That is, each of the electromagnets 101 to 107 and 111 to 117 applies the electromagnetic force in the through-thickness direction Z to each portion of the opposing steel sheet 2, and thus, each portion of the steel sheet 2 is magnetically attracted in the through-thickness direction Z. Accordingly, each portion in the transverse direction Y of the steel sheet 2 is magnetically attracted with a different intensity in all electromagnet groups 12 and 12, and thus, the shape in the transverse direction Y of the steel sheet 2 can be corrected to an arbitrary target correction shape 20.

Next, the coating amount measurement device 13 will be described. The coating amount measurement devices 13 and 13, which are disposed to be opposite to each other in both sides in the through-thickness direction Z of the conveyed steel sheet 2, are provided in the latter stage of the line of the continuous hot-dip metal coating apparatus 1. In the present preferred embodiment, for example, as the coating amount measurement devices 13 and 13, an X-ray fluorescent device is used. In the X-ray fluorescent device, an X-ray is radiated on each of the front and the rear surfaces of the steel sheet 2, the amount of the X-ray fluorescence emitted from the applied coating is measured, and thus, the amount of the coating applied to each of the front and the rear surfaces of the steel sheet 2 can be measured.

Moreover, each coating amount measurement device 13 is disposed to be separated by a predetermined distance from the steel sheet 2 so as not to contact the steel sheet 2 even when the steel sheet 2 conveyed in the transporting direction X vibrates in the through-thickness direction Z. The plurality of coating amount measurement devices 13 may be disposed at a predetermined interval along the transverse direction Y of the steel sheet 2, and only one coating amount measurement device 13 may be disposed to scan in the transverse direction. Accordingly, the coating amount in the transverse direction Y of the steel sheet 2 can be measured. Therefore, the shape (the warp shape with respect to the axis in the transverse direction Y) in the transverse direction Y of the steel sheet 2 can be estimated using the measured coating amount.

Next, the control device 14 will be described. The control device 14 is configured of a calculation processor such as a microprocessor. The database 15 is configured of a storage device such as a semiconductor memory or a hard disk drive and is accessible by the control device 14. Moreover, the above-described sensors 11 and 11, electromagnet groups 12 and 12, and coating amount measurement devices 13 and 13 are connected to the control device 14. The control device 14 controls each of the electromagnets 101 to 107 and 111 to 117 of the electromagnet groups 12 and 12 based on the measured results of the sensors 11 and 11 or the coating amount measurement devices 13 and 13. At this time, as a control system, a feedback control, for example, a PID control, may be used. The control device 14 sets a control parameter for the PID control and controls the operation of each of the electromagnets 101 to 107 and 111 to 117 using the control parameter. The control parameter is a parameter for controlling the electromagnetic force applied to the steel sheet 2 by controlling the current flowing to each of the electromagnets 101 to 107 and 111 to 117. For example, the control parameter includes a control gain (that is, a proportional gain $K_p$, an integration gain and a differential gain $K_d$), or the like of each of a proportional operation (P operation), an integration operation (I operation), and a differential operation (D operation) of the PID control. The control device 14 sets each control gain between 0% and 100% and controls the electromagnetic force generated by each of the electromagnets 101 to 107 and 111 to 117.

Information of the measured results of the positions in the through-thickness direction Z of each portion in the transverse direction Y of the steel sheet 2 at the sensor positions is input to the control device 14 from the sensors 11 and 11. Moreover, information of the measured results of the coating amount with respect to the front and the rear surfaces of the steel sheet 2 is input to the control device 14 from the coating amount measurement devices 13 and 13. The control device 14 controls each of the electromagnets 101 to 107 and 111 to 117 of electromagnet groups 12 and 12 based on the information of the position in the through-thickness direction Z or the coating amount, the information of various passing conditions, the information held in the database 15, or the like. At this time, the control device 14 controls each of the electromagnets 101 to 107 and 111 to 117 independently so that the shape in the transverse direction Y of the steel sheet 2 at the electromagnet positions is a proper target correction shape 20, and applies the electromagnetic force in the through-thickness direction Z with respect to each portion of the steel sheet 2 from each of the electromagnets 101 to 107 and 111 to 117.

Specifically, for example, the control device 14 calculates the positions in the through-thickness direction Z of each portion in the transverse direction Y of the steel sheet 2 at the electromagnet positions based on the measured results (that is, the positions in the through-thickness direction Z of each portion in the transverse direction Y of the steel sheet 2 at the sensor positions) by the sensors 11 and 11. Moreover, the control device 14 controls the electromagnet groups 12 and 12 based on the calculated positions in the through-thickness direction Z of each portion, applies the electromagnetic force to each portion in the transverse direction Y of the steel sheet 2, and corrects the shape in the transverse direction Y of the steel sheet 2 to the target correction shape 20.

Moreover, the control device 14 calculates the positions in the through-thickness direction Z of each portion in the transverse direction Y based on the measured results (that is, the coating amount of each portion in the transverse direction Y of the steel sheet 2 at the wiping nozzle position) of the coating amount of the front and the rear surfaces of the steel sheet 2 input from the coating amount measurement devices 13 and 13, and thus, can correct the shape in the transverse direction Y of the steel sheet 2 to the target correction shape 20. In this case, for example, using correlation data held in the database 15 in advance, the control device 14 calculates the positions in the through-thickness direction Z of each portion along the transverse direction Y of the steel sheet 2 at the wiping nozzle positions from the measured coating amount of the front and the rear surfaces of the steel sheet 2. The correlation data is data in which correlation between the coating amount with respect to the steel sheet 2 and the positions in the through-thickness direction Z of each portion along the transverse direction Y of the steel sheet 2 under various passing conditions is experimentally or empirically obtained in advance. Moreover, the control device 14 controls the electromagnet groups 12 and 12 based on the positions in the through-thickness direction Z of each portion in the transverse direction Y of the steel sheet 2 calculated from the coating amount, applies the electromagnetic force to each portion in the transverse direction Y of the steel sheet 2, and corrects the shape in the transverse direction Y of the steel sheet 2 to the target correction shape 20.

In addition, each of the electromagnets 101 to 107 and each of the electromagnets 111 to 117 disposed to be opposite to each other are set so that the steel sheet 2 is magnetically attracted to one side or both sides of each pair of the electromagnets at the same position in the transverse direction Y. For example, as shown in FIG. 3, in the pair of the electromagnet 101 and the electromagnet 111 of the position in the transverse direction Y opposite to each other in one end of the steel sheet 2, an output of the electromagnet 111 positioned at a side distant from the steel sheet 2 is set to be larger than an output of the electromagnet 107 positioned at a side close to the steel sheet 2. Moreover, the outputs of the electromagnets are set so that one end of the steel sheet 2 is magnetically attracted by the electromagnets 101 and 111 in a direction (direction from the electromagnet 101 toward the electromagnet 111) in which the shape in the transverse direction Y of the steel sheet 2 at the electromagnet position becomes the target correction shape 20 and the shape correction is performed. Moreover, when the pair of the electromagnets is positioned at the equal distance from the corresponding portions of the steel sheet 2 (that is, when the portions of the steel sheet 2 are positioned on the center line 22), since it is not necessary to correct the portions of the steel sheet 2 in the through-thickness direction Z, the outputs of the electromagnets are set to be equal to each other.

In addition, the control device 14 can set starting and stopping of the plurality of sensors 11 disposed along the transverse direction Y of the steel sheet 2, or of the coating amount measurement device 13 and the plurality of electromagnets 101 to 107 and 111 to 117, individually. When a width W of the steel sheet 2 is large (for example, W=1700 mm), all of the plurality of sensors 11 in the transverse direction Y are opposite to steel sheet 2. In contrast, in a case where the width W of the steel sheet 2 is small (for example, W=900 mm), when the steel sheet 2 having a narrow width W passes, the sensors 11 positioned at the center portion side of the plurality of sensors 11 are opposite to the steel sheet 2, but the sensors 11 disposed in both end sides are not opposite to the steel sheet 2. This is similarly applied to the plurality of coating amount measurement devices 13 and the plurality of electromagnets 101 to 107 and 111 to 117 which are disposed along the transverse direction Y.

Accordingly, in the present preferred embodiment, for example, as the passing condition of the steel sheet 2, the control device 14 obtains the information of the width W of the steel sheet 2 conveyed in the transporting direction X, in advance, and starts only the sensors, the coating amount measurement device, and the electromagnets which are actually opposite to the steel sheet 2, among the plurality of sensors 11, the coating amount measurement device 13, and the plurality of electromagnets 101 to 107 and 111 to 117, based on the information of the sheet width W. Therefore, according to the width W of the steel sheet 2 processed by the continuous hot-dip metal coating apparatus 1, the measurement of the position of each portion in the transverse direction Y of the steel sheet 2, the measurement of the coating amount, the shape correction, or the like can be appropriately performed.

For example, in the example of FIG. 3, the pair of electromagnets 104 and 114 is disposed in the center in the transverse direction Y, and for example, the plurality of pairs of electromagnets 101 to 103, 105 to 107, 111 to 113, and 115 to 117 are disposed at 250 mm intervals in the transverse direction Y. In this case, with respect to the steel sheet 2 having the sheet width W=900 mm, 3 pairs of electromagnets 103 to 105 and 113 to 115 of the center side can provide the electromagnetic forces. In addition, with respect to the steel sheet 2 having the sheet width W=1700 mm, all of 7 pairs of electromagnets 101 to 107 and 111 to 117 can provide the electromagnetic forces.

The steel sheet shape control apparatus 10 is configured as described above. According to the steel sheet shape control apparatus 10, the shape in the transverse direction Y of the steel sheet 2 at the electromagnet positions is corrected to the target correction shape 20 using each of the electromagnets 101 to 107 and 111 to 117, and thus, a steel sheet shape control method in accordance with the present preferred embodiment is realized, and the details will be described below.

3. CORRECTION SHAPE AT ELECTROMAGNET POSITION

Figure 4:
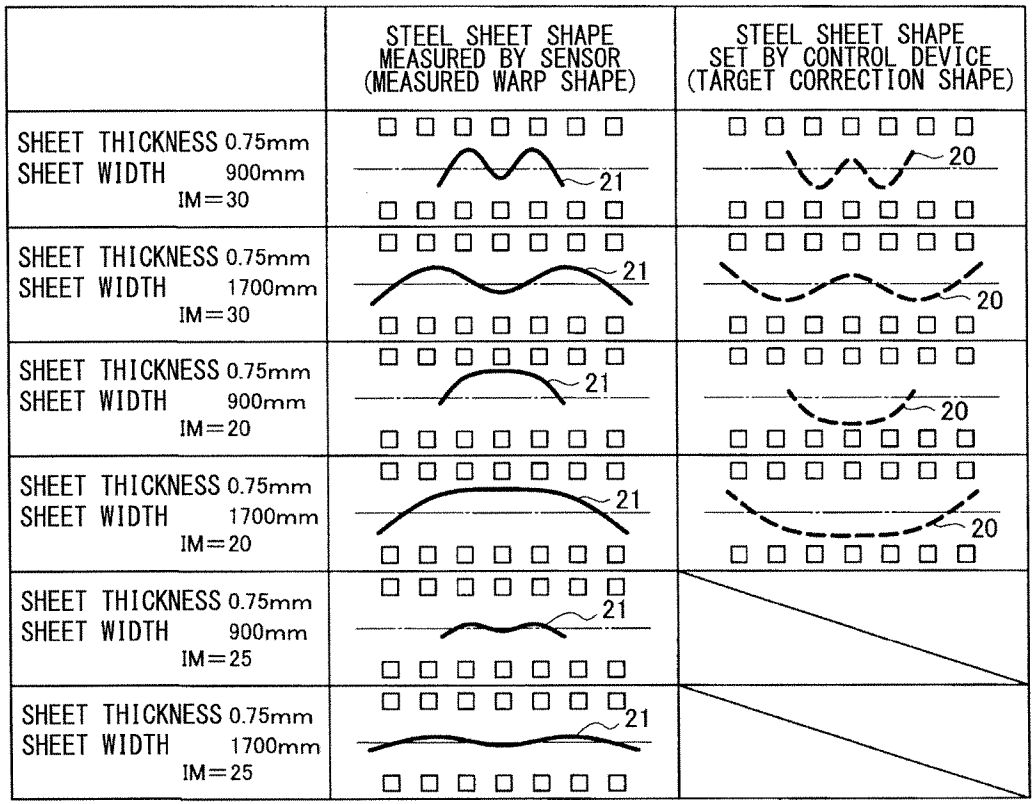
FIG. 4 is a horizontal cross-section diagram showing a target correction shape of the steel sheet at an electromagnet position in accordance with the first and second preferred embodiments.

Next, the target correction shape 20 when the shape of the steel sheet 2 is corrected by the steel sheet shape control apparatus 10 will be described with reference to FIG. 4. FIG. 4 is a schematic diagram showing the actual warp shape 21 and the target correction shape 20 of the steel sheet 2 at the electromagnet positions in accordance with the present preferred embodiment. In FIG. 4, solid lines indicate the actual warp shapes 21 (hereinafter, referred to as a "measured warp shape 21") in the transverse direction Y of the steel sheet 2 at the electromagnet positions which are measured in the state where the electromagnetic forces are not applied, and dashed lines indicate the target correction shapes 20 in the transverse direction Y of the steel sheet 2 which are set by the control device 14 of the steel sheet shape control apparatus 10.

As shown in FIG. 4, the control device 14 sets the target correction shape 20 in the transverse direction Y of the steel sheet 2 according to the measured warp shape (measured warp shape 21) in the transverse direction Y of the steel sheet 2 at the electromagnet positions. In the present preferred embodiment, the target correction shape 20 is set to a curved shape which is symmetrical in the through-thickness direction Z to the measured warp shape 21. That is, the target correction shape 20 and the measured warp shape 21 are symmetrical in the through-thickness direction Z with the center line 22 as a symmetrical axis. Moreover, a plurality of squares in FIG. 4 means the electromagnets 101 to 107 and 111 to 117 (refer to FIG. 3).

For example, in cases of (a) and (b) of FIG. 4, the steel sheet 2 is subjected to the so-called W warp at the electromagnet positions, and the measured warp shape 21 of the steel sheet 2 becomes a W-shaped curved shape (irregular shape) having a plurality of irregularities. The amount of warp $d_M$ of the W warp is equal to or more than a predetermined threshold value $d_{th}$. In this case, the target correction shape 20 of the steel sheet 2 is set to a W-shaped curved shape which is symmetrical in the through-thickness direction Z with the center line 22 as the symmetrical axis.

In addition, in cases of (c) and (d) of FIG. 4, the steel sheet 2 is subjected to the so-called C warp at the electromagnet positions, and the measured warp shape 21 of the steel sheet 2 becomes a C-shaped curved shape having one convex portion. The amount of warp $d_M$ of the C warp is equal to or more than the predetermined threshold value $d_{th}$. In this case, the target correction shape 20 of the steel sheet 2 is set to a C-shaped curved shape which is symmetrical in the through-thickness direction Z with the center line 22 as the symmetrical axis.

On the other hand, in cases of (e) and (t) of FIG. 4, the steel sheet 2 is substantially flat at the electromagnet positions, the measured warp shape 21 of the steel sheet 2 is almost not bent in the through-thickness direction Z, and the amount of warp $d_M$ is less than the predetermined threshold value $d_{th}$. In this case, the target correction shape 20, which is curved by the amount of warp of the threshold value $d_{th}$ or more, cannot be set. Accordingly, by adjusting IM or the disposition of the rolls in the bath as described below, the steel sheet 2 at the electromagnet positions is curved in the transverse direction Y, and the shape in the transverse direction Y of the steel sheet 2 at the electromagnet positions is adjusted so that the measured warp shape 21 is the curved shape having the amount of warp $d_M$ of the threshold $d_{th}$ or more. Moreover, similar to (a) to (d) of FIG. 4, the target correction shape 20 is set.

In this way, the control device 14 sets the target correction shape 20 of the steel sheet 2 at the electromagnet positions to the curved shape which is symmetrical to the measured warp shape 21. Moreover, the shape of the steel sheet 2 is corrected using the plurality of pairs of electromagnets 101 to 107 and 111 to 117 opposite to the steel sheet 2 so that the shape in the transverse direction Y of the steel sheet 2 at the electromagnet positions is the target correction shape 20.

In this way, in the present preferred embodiment, the shape in the transverse direction Y of the steel sheet at the electromagnet positions is not formed in a flat shape, and is positively corrected to curved shapes (irregular shapes) such as the C shape, the W shape, or a zigzag shape. Rigidity of the steel sheet 2 passing through between the wiping nozzles 8 and 8 and the electromagnet groups 12 and 12 can be increased. Moreover, since the shape in the transverse direction Y of the steel sheet at the nozzle position can be close to a flat shape, the coating thickness in the transverse direction Y can be uniformized by the wiping nozzles 8 and 8, and vibration of the steel sheet 2 conveyed in the transporting direction X can be suppressed.

Moreover, even when the target correction shape 20 is not set to a curved shape which is completely symmetrical to the measured warp shape 21, if the target correction shape is set to the curved shape corresponding to the measured warp shape 21, the rigidity of the steel sheet 2 is increased, and effects which flatten the steel sheet shape at the nozzle position and vibration suppression effects can be obtained.

4. STEEL SHEET SHAPE CONTROL METHOD

Next, a steel sheet shape control method, which uses the steel sheet shape control apparatus 10 configured as above, will be described.

(4.1 Overall Flow of Steel Sheet Shape Control Method)

Figure 5:
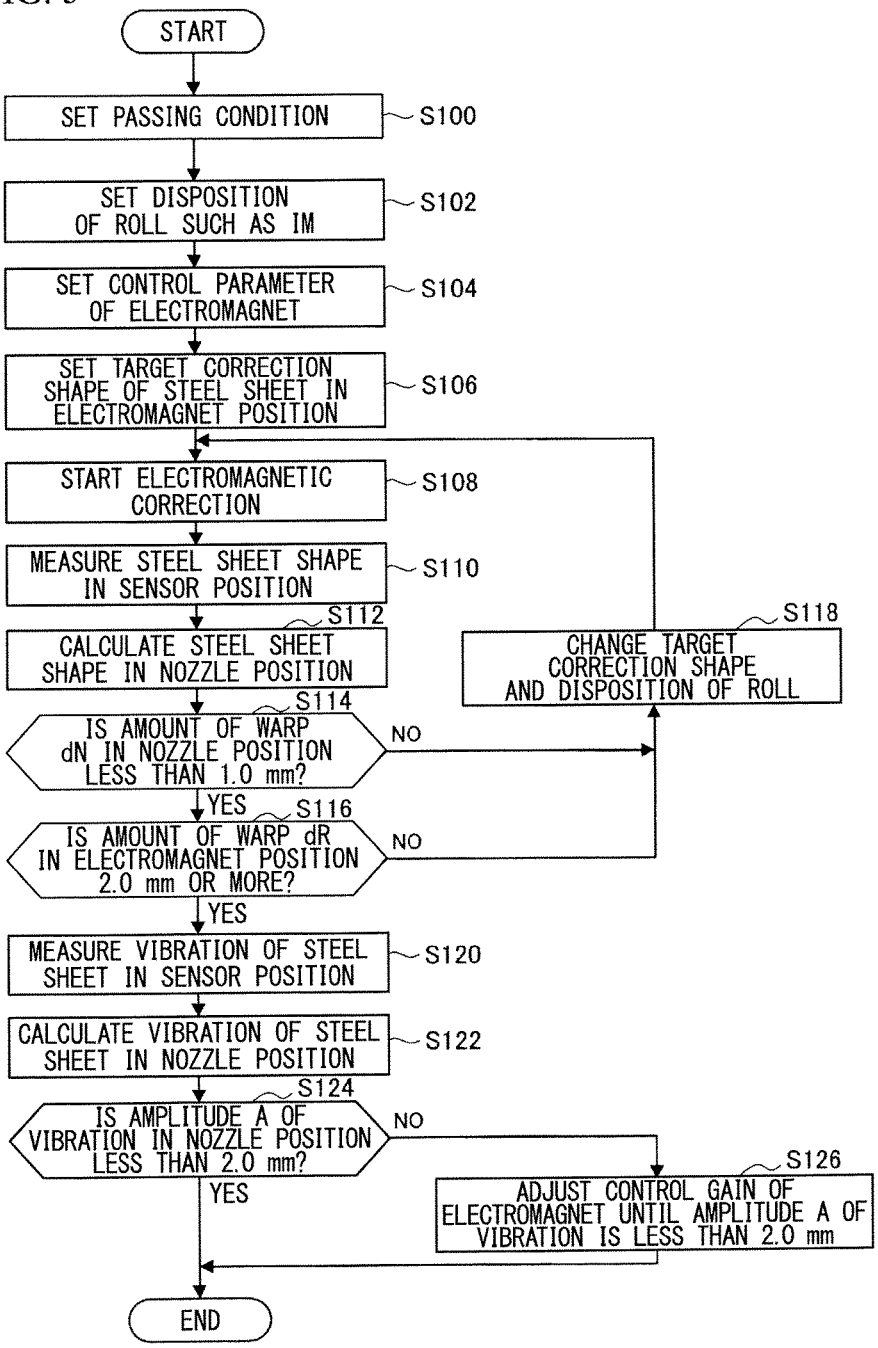
FIG. 5 is a flowchart showing a steel sheet shape control method in accordance with the first and second preferred embodiments.

First, an overall flow of the steel sheet shape control method in accordance with the present preferred embodiment will be described with reference to FIG. 5. FIG. 5 is a flowchart showing the steel sheet shape control method in accordance with the present preferred embodiment.

As shown in FIG. 5, first, the control device 14 sets passing conditions of the steel sheet 2 in the continuous hot-dip metal coating apparatus 1 (S100). Here, the passing conditions are conditions which are determined when the steel sheet 2 lifted from the coating bath 3 passes between the wiping nozzles 8 and 8, the electromagnet groups 12 and 12, and the like. For example, the passing conditions include a thickness D of the steel sheet 2, the sheet width W, a tension T in the longitudinal direction (transporting direction X) of the steel sheet, the dispositions and the sizes (diameter) of the rolls in the bath such as the sink roll 5 or the support rolls 6 and 7, or the like.

Subsequently, the control device 14 sets the dispositions of the rolls in the bath such as Inter Mesh (IM) of the support rolls 6 and 7 based on the passing conditions which are set in S100 (S102). After S102, the rolls in the bath such as the sink roll 5 and the support rolls 6 and 7 are adjusted in the disposition set in S102. Since the support rolls 6 and 7 are not provided in the continuous hot-dip metal coating apparatus 1 in accordance with the first preferred embodiment shown in FIG. 1, it is not necessary to set and adjust the IM.

S102 will be described in detail. The control device 14 sets the disposition of the rolls in the bath using the information stored in the database 15. Roll disposition information, which associates various passing conditions with a proper value of the disposition of the rolls in the bath such as IM, is stored in the database 15. The roll disposition information is information which determines proper values of the roll disposition such as the IM for each passing condition based on a past operation result or a test result determined by a tester of the continuous hot-dip metal coating apparatus 1. The control device 14 sets the proper dispositions of the sink roll 5 and the support rolls 6 and 7, the proper size of the IM, or the like according to the passing conditions such as the sheet thickness D, the sheet width W, or the tension T set in S100, using the roll disposition information. For example, the IM or the like is set so that the amount of warp $d_M$ of the shape in the transverse direction Y of the steel sheet 2 at the electromagnet position is a value (for example, 2.0 mm$\leq d_M <$20 mm) which is within a relatively large predetermined range. According to the roll disposition, the steel sheet 2 is curved in the transverse direction Y by the rolls in the bath, and the shape in the transverse direction Y of the steel sheet 2 at the electromagnet position becomes a curved shape.

Thereafter, the control device 14 sets the current output and the control parameter of each of the electromagnets 101 to 107 and 111 to 117 based on the passing condition and the roll disposition which are set in S100 and S102 (S104). For example, when the control system is the PID control, the control parameter is the control gain (a proportional gain $K_p$, an integration gain $K_i$, and a differential gain $K_d$) or the like of each of the electromagnets 101 to 107 and 111 to 117. The control device 14 sets each of the control gains $K_p$, $K_i$, and $K_d$ to proper values between 0% and 100% according to the set passing condition and roll disposition.

Also when the control gain is set, the control device 14 uses the information stored in the database 15. The control parameter information, which associates various passing conditions and the disposition of the rolls in the bath with the proper value of the control parameter, is stored in the database 15. The control parameter information is information which determines proper values of the control parameters such as the control gains $K_p$, $K_i$, and $K_d$ for each passing condition and each roll disposition, based on the past operation result or the test result determined by a tester of the continuous hot-dip metal coating apparatus 1. The control device 14 sets control parameters such as proper control gains $K_p$, $K_i$, and $K_d$ according to the passing condition and the roll disposition set in S100 and S102, using the control parameter information.

Moreover, the control device 14 sets the target correction shape 20 in the transverse direction Y of the steel sheet 2 at the electromagnet position based on the passing condition, the roll disposition, or the like set in S100 and S102 (S106). The target correction shape 20 is a target shape in the transverse direction Y of the steel sheet 2 at the electromagnet position which is corrected by the electromagnets 101 to 107 and 111 to 117. The control device 14 sets the target correction shape 20 to a curved shape corresponding to the warp shape (that is, the above-described measured warp shape 21) in the transverse direction Y of the steel sheet 2 at the electromagnet position. For example, the control device 14 sets the target correction shape 20 to the shape (refer to FIG. 4) symmetrical in the through-thickness direction Z to the measured warp shape 21. For example, calculation processing for setting the target correction shape 20 is carried out by performing a first numerical analysis using steel sheet shape calculation software. In addition, the details of a setting method of the target correction shape 20 in S106 will be described below (refer to FIG. 6 or the like).

Figure 7:
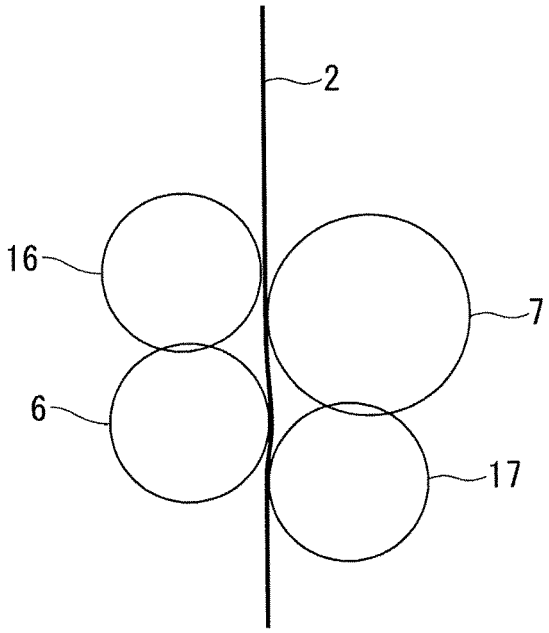
FIG. 7 is a diagram showing a model in a first numerical analysis in accordance with the first and second preferred embodiments.

In the first numerical analysis, first, strain amounts of the front and the rear surfaces of the steel sheet are calculated using a two-dimensional plane strain model. Next, a three-dimensional model is used to calculate the steel sheet shape in the transverse direction. At this time, as shown in FIG. 7, a three-dimensional model is used in which two nonexistent rolls (virtual rolls) 16 and 17 are additionally disposed and the steel sheet 2 moves among four disposed support rolls. Here, the shape (the steel sheet shape at the nozzle position) in the transverse direction Y of the steel sheet 2 at the nozzle position is calculated by adjusting the pushing-in amount of the virtual rolls to apply 70% of the strain amount calculated by the two-dimensional model, and the target correction shape 20 is set so that the steel sheet shape at the nozzle position is close to a flat shape.

Thereafter, the electromagnetic forces are applied to the steel sheet 2 by the electromagnets 101 to 107 and 111 to 117 according to the conditions set in S104 and S106 while making the steel sheet 2 actually pass through the continuous hot-dip metal coating apparatus 1 according to the passing condition and the roll disposition set in S100 and S104, and thus, the electromagnetic correction of the steel sheet 2 is performed (S108). In the electromagnetic correction, the control device 14 controls the current flowing to each of the electromagnets 101 to 107 and 111 to 117 so that the shape in the transverse direction Y of the steel sheet 2 at the electromagnet position is corrected to the target correction shape 20 set in S106, and thus, the electromagnetic force is applied to the steel sheet 2 by each of the electromagnets 101 to 107 and 111 to 117. Accordingly, the actual shape in the transverse direction Y of the steel sheet 2 at the electromagnet position is corrected to the target correction shape 20.

Subsequently, the shape (hereinafter, referred to as a "steel sheet shape at a sensor position") in the transverse direction Y of the steel sheet 2 at the sensor position is measured by the sensors 11 and 11 when the steel sheet 2 passes in the state where the electromagnetic forces are applied as in S108 (S110). As described above, the sensor 11 is configured of the distance sensor or the like which measures the distance to the steel sheet 2 and can measure the position (displacement) in the through-thickness direction Z of each portion in the transverse direction Y of the steel sheet 2 at the sensor position. The control device 14 can calculate the steel sheet shape at the sensor position from the information of the position measured by the sensor 11.

Subsequently, the control device 14 calculates the shape (hereinafter, referred to as a "steel sheet shape at a nozzle position") in the transverse direction Y of the steel sheet 2 at the nozzle position based on the steel sheet shape at the sensor position measured in S110, the passing condition, and the roll disposition, or the like (S112). For example, this calculation is carried out by performing the first numerical analysis using the steel sheet shape calculation software. The control device 14 can obtain the steel sheet shape at the nozzle position from the steel sheet shape at the sensor position measured in S100 by considering conditions of the sheet thickness D, the sheet width W, the tension T, the disposition or the sizes of the rolls in the bath, or the like.

Subsequently, the control device 14 determines whether or not the amount of warp $d_N$ of the steel sheet shape at the nozzle position calculated in S112 is less than a predetermined upper limit value $d_{Nmax}$ (first upper limit value) (S114). Here, similar to the amount of warp $d_M$ of the steel sheet shape at the electromagnet position shown in FIG. 3, the amount of warp $d_N$ of the steel sheet shape at the nozzle position means the length in the through-thickness direction Z from the most protruded portion of the steel sheet 2 at the nozzle position to the most recessed portion. Moreover, the upper limit value $d_{Nmax}$ of the amount of warp $d_N$ is the upper limit of the amount of warp in which uniformity of the coating thickness in the transverse direction Y at the nozzle position can be secured.

In the present preferred embodiment, the upper limit value $d_{Nmax}$ of the amount of warp $d_N$ is set to 1.0 mm. If the amount of warp $d_N$ of the steel sheet shape at the nozzle position is 1.0 mm or more, since the steel sheet shape at the nozzle position is not a flat shape, dispersion of the coating thickness in the transverse direction Y of the steel sheet 2 is increased, and desired uniformity of the coating thickness cannot be obtained. Accordingly, it is determined whether or not the amount of the warp $d_N$ of the steel sheet shape at the nozzle position is less than 1.0 mm in S114.

Moreover, the control device 14 determines whether or not the amount of warp $d_R$ of the shape (hereinafter, referred to as a "steel sheet shape in an electromagnet position at electromagnetic correction") in the transverse direction Y of the steel sheet 2 at the electromagnet position in the state where the electromagnetic forces are applied is within a predetermined range (S116). Here, similar to the amount of warp $d_M$ of the steel sheet shape at the electromagnet position when the electromagnetic correction is not performed as shown in FIG. 3, the amount of warp $d_R$ of the steel sheet shape at the electromagnet position at the electromagnetic correction means the length in the through-thickness direction Z from the most protruded portion of the steel sheet 2 at the electromagnet position to the most recessed portion. Moreover, the predetermined range (lower limit value $d_{Rmin}$ to upper limit value $d_{Rmax}$) of the amount of warp $d_R$ is a range of the amount of warp $d_R$ which is required to suppress the vibration of the steel sheet 2.

In the present preferred embodiment, the lower limit value $d_{Rmin}$ in the predetermined range of the amount of warp $d_R$ is set to 2.0 mm, and the upper limit value $d_{Rmax}$ is set to 20 mm. If the amount of warp $d_R$ is less than 2.0 mm, the rigidity of the steel sheet 2 is insufficient, and there is a problem that the steel sheet 2 easily vibrates at the nozzle position. Accordingly, it is determined whether or not the amount of warp $d_R$ of the steel sheet shape at the electromagnet position at the electromagnetic correction is 2.0 mm or more in S116. Moreover, when the steel sheet 2 is a wide steel sheet (for example, the sheet width W is 1700 mm or more), if the amount of warp $d_R$ exceeds 20 mm, there is a problem that probability of the steel sheet 2 electromagnetically corrected at the electromagnet position contacting the electromagnets 101 to 107 and 111 to 117 is increased. That is, the warp (C warp, W warp, or the like) is generated when the steel sheet 2 passes around the sink roll 5 and the support rolls 6 and 7, but in the wide steel sheet, the amount of warp at this time is increased. Accordingly, the warp of the wide steel sheet at the electromagnet position is corrected to a reverse shape, and if the amount of warp $d_R$ exceeds 20 mm, there is a concern that the ends in the transverse direction Y of the wide steel sheet at the electromagnet position may contact the electromagnets 101 to 107 and 111 to 117. Therefore, when the steel sheet 2 is the wide steel sheet in S116, it is determined whether or not the amount of warp $d_R$ is 2.0 mm or more and 20 mm or less.

When the amount of warp $d_N$ of the steel sheet shape at the nozzle position is equal to or more than the predetermined upper limit value $d_{Nmax}$ (for example, 1.0 mm or more) as a result of the determination in S114, or when the amount of warp $d_R$ of the steel sheet shape at the electromagnet position at the electromagnetic correction is outside the predetermined range (for example, less than 2.0 mm or more than 20 mm) as a result of the determination in SI 16, processing of S118 is performed.

In S118, the control device 14 changes and resets the target correction shape 20 set in S106, or changes and resets the disposition of the rolls in the bath set in S102 (S118). At this time, both of the target correction shape 20 and the disposition of the rolls in the bath may be changed, or only one of both may be changed. However, the target correction shape 20 or the disposition of the rolls in the bath is changed so that the amount of warp $d_N$ of the steel sheet shape at the nozzle position is less than the upper limit value $d_{Nmax}$ ($d_N$<1.0 mm) and the amount of warp $d_R$ of the steel sheet shape in the electromagnet position at the electromagnetic correction is within the predetermined range ($d_R \geq 2.0$ mm, and 2.0 mm$\leq d_R \leq$20 mm when the steel sheet is the wide steel sheet).

For example, when it is determined that the amount of warp $d_N$ of the steel sheet shape at the nozzle position in S114 is 1.0 mm or more, in order to decrease the amount of warp $d_N$, the amount of warp $d_M$ of the target correction shape 20 at the electromagnet position is reset to be a smaller value. Moreover, when it is determined that the amount of warp $d_R$ of the steel sheet shape in the electromagnet position at the electromagnetic correction of the wide steel sheet in S116 exceeds 20 mm, in order to decrease the amount of warp $d_R$, the amount of warp $d_M$ of the target correction shape 20 at the electromagnet position is reset to a smaller value by performing the first numerical analysis to the amount of warp $d_M$ (S118). The steel sheet shape is measured (S110 and S112) in the state where the electromagnetic correction is performed on the steel sheet 2 to be the reset target correction shape 20 (S108), and the determination of S114 and S116 is retried.

For example, when it is determined that the amount of warp $d_R$ of the steel sheet shape in the electromagnet position at the electromagnetic correction in S116 is less than 2.0 mm, the disposition of the sink roll 5 or the support rolls 6 and 7 provided in the coating bath is adjusted so that the amount of warp $d_R$ is increased. For example, the disposition is adjusted to increase the IM of the support rolls 6 and 7, and thus, the amount of warp $d_R$ of the steel sheet shape in the electromagnet position at the electromagnetic correction can be increased. Moreover, the disposition of the rolls in the bath is adjusted as described above, the steel sheet 2 passes the rolls, the steel shape is measured (S110 and S112) in the state where the electromagnetic correction of the steel sheet 2 is performed (S108), and thus, the determination of S114 and S116 is retried.

As described above, in the present preferred embodiment, when the actual amounts of the warp $d_N$ and $d_R$ of the steel sheet shape of the electromagnet position or the nozzle position are not proper under the condition which is set at first in S102 and S106, the target correction shape 20 or the roll disposition is adjusted or reset in S118. Accordingly, the amount of warp $d_N$ of the steel sheet shape at the nozzle position can be less than 1.0 mm, and the amount of warp $d_R$ of the steel sheet shape in the electromagnet position at the electromagnetic correction can be 2.0 mm or more and 20 mm or less.

After processes until the above, continuously, processes (S120 to S126) for suppressing the vibration of the steel sheet 2 at the nozzle position are performed.

First, the control device 14 measures the vibration in the through-thickness direction Z of the steel sheet 2 at the sensor position by sensors 11 and 11 (S120). Since the sensor 11 can measure the position (displacement) in the through-thickness direction Z of each portion in the transverse direction Y of the steel sheet 2 at the sensor position, if the position is continuously measured by the sensor 11, the amplitude and the frequency of the vibration in the through-thickness direction Z of the steel sheet 2 at the sensor position can be obtained.

Subsequently, the control device 14 calculates the vibration in the through-thickness direction Z of the steel sheet 2 at the nozzle position by performing a second numerical analysis based on the vibration in the through-thickness direction Z of the steel sheet 2 at the sensor position measured in S120, the passing condition, the roll disposition, or the like (S122). The control device 14 can obtain the vibration of the steel sheet 2 at the nozzle position from the vibration of the steel sheet 2 at the sensor position measured in S120 by considering conditions of the sheet thickness D, the sheet width W, the tension T, the disposition or the sizes of the rolls in the bath, or the like.

Figure 8:
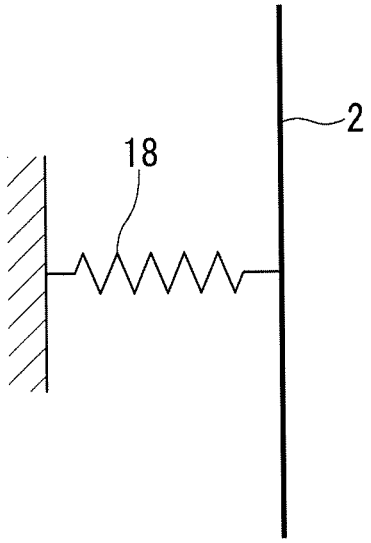
FIG. 8 is a diagram showing a model in a second numerical analysis in accordance with the first and second preferred embodiments.

In the second numerical analysis, as shown in FIG. 8, a virtual roll spring 18 is disposed in the X direction at the position in which the vibration of the steel sheet 2 is calculated, and the vibration of the steel sheet 2 is calculated using the spring constant of the roll spring 18.

Thereafter, the control device 14 determines whether or not the amplitude A of the vibration of the steel sheet 2 at the nozzle position calculated in S122 is less than a predetermined upper limit value $A_{max}$ (second upper limit value) (S124). Here, the upper limit value $A_{max}$ of the amplitude A is the upper limit of the amplitude A in which uniformity of the coating thickness in the transporting direction X of the steel sheet 2 can be secured. If the steel sheet 2 is largely vibrated at the nozzle position, the distances between the wiping nozzle 8 and the front and the rear surfaces of the steel sheet 2 are increased or decreased periodically according to passing of the steel sheet 2, and thus, dispersion occurs in the coating thickness in the transporting direction X of the steel sheet 2.

In the present preferred embodiment, the upper limit value $A_{max}$ of the amplitude A is set to 2.0 mm. Here, the amplitude A is both amplitudes. If the amplitude A of the vibration of the steel sheet 2 at the nozzle position is 2.0 mm or more, the dispersion of the coating thickness in the longitudinal direction (transporting direction X) of the steel sheet 2 is increased, and desired uniformity of the coating thickness cannot be secured. Accordingly, in S124, it is determined whether or not the amplitude A of the vibration of the steel sheet 2 at the nozzle position is less than 2.0 mm.

As a result of the determination in S124, when the amplitude A of the vibration of the steel sheet 2 at the nozzle position is equal to or more than the upper limit value $A_{Nmax}$ (for example, 2.0 mm or more), the processing of S126 is performed.

In S126, the control device 14 gradually decreases the control gains of the electromagnets 101 to 107 and 111 to 117 until the amplitude A of the vibration of the steel sheet 2 at the nozzle position is decreased to be less than the upper limit value $A_{Nmax}$ (S126). For example, when the control system of the electromagnet is the PID control, the control device 14 gradually decreases the proportional gain $K_p$ of the proportional operation (P operation) of the PID control as the control gain. Moreover, at the time when the amplitude A is decreased to be less than the upper limit value $A_{Nmax}$ by continuously measuring the amplitude A while decreasing the proportional gain $K_p$, the control device 14 stops the decrease of the proportional gain $K_p$ and resets $K_p$. Thereafter, the control device 14 controls the electromagnets 101 to 107 and 111 to 117 using the reset proportional gain $K_p$ and other control gains $K_i$ and $K_d$.

The inventors studied diligently, and as a result, found that a force (hereinafter, referred to as a "steel sheet restraining force) restraining the steel sheet 2 by the electromagnetic force at the electromagnet position was weakened if the proportional gain $K_p$ of the proportional operation (P operation) of the PID control was decreased, and thus, the amplitude A of the vibration of the steel sheet 2 at the nozzle position was decreased. Accordingly, in the present preferred embodiment, the amplitude A of the vibration of the steel sheet at the nozzle position is suppressed to be less than the upper limit value $A_{Nmax}$ (for example, less than 2.0 mm) by decreasing the proportional gain $K_p$ as the control gains of the electromagnets 101 to 107 and 111 to 117 (S126). Therefore, since the distances between the wiping nozzle 8 and the front and the rear surfaces of the steel sheet 2 can be approximately constant, the dispersion of the coating thickness in the transporting direction X of the steel sheet 2 is decreased, and thus, uniformity of the coating thickness in the transporting direction X can be secured.

(4.2 Specific Example of Setting Method of Steel Sheet Shape)

Next, a method of setting the target correction shape 20 in the transverse direction Y of the steel sheet 2 at the electromagnet position in S106 of FIG. 5 will be described in detail. For example, as a method of setting the target correction shape 20, the following two methods may be exemplified.

(1) Method of Measuring Steel Sheet Shape in Electromagnet Position

Figure 6:
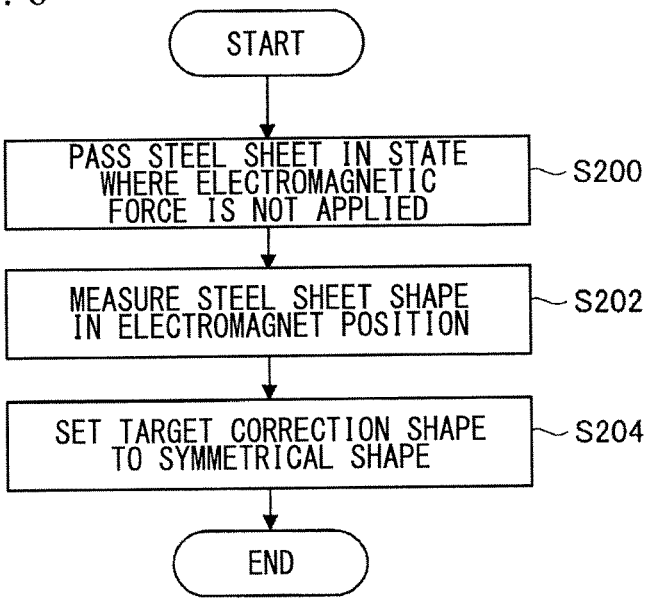
FIG. 6 is a flowchart showing a specific example of a setting method of the target correction shape in accordance with the first and second preferred embodiments.

In the present setting method, when the steel sheet 2 passes through the state where the electromagnetic correction is not performed, the warp shape 21 in the transverse direction Y of the steel sheet 2 at the electromagnet position is actually measured, and the target correction shape 20 is set to the curved shape corresponding to the measured warp shape 21 (refer to FIG. 4). This setting method will be described with reference to FIG. 6. FIG. 6 is a flowchart showing a specific example of the setting method of the target correction shape 20 in accordance with the present preferred embodiment.

As shown in FIG. 6, first, the steel sheet 2 is conveyed in the continuous hot-dip metal coating apparatus 1 in a state where the electromagnetic forces are not applied to the steel sheet 2 by the electromagnets 101 to 107 and 111 to 117 (S200). Subsequently, the steel sheet shape at the electromagnet position when the electromagnetic correction is not preformed is measured by measuring the position in the through-thickness direction Z of each portion in the transverse direction Y of the steel sheet 2 at the electromagnet position by the position sensors 121 to 127 and 131 to 137 at the electromagnet positions (S202).

Thereafter, the control device 14 calculates the curved shape which is symmetrical in the through-thickness direction Z to the measured warp shape 21 at the electromagnet positions measured in S202, and sets the target correction shape 20 at the electromagnet position to the symmetrical curved shape (S204). For example, as shown in FIG. 4, the target correction shape 20 is set to the curved shape symmetrical in the through-thickness direction Z to the measured warp shape 21 with the center line 22 as the symmetrical axis.

As described above, in the present setting method, the target correction shape 20 is set based on the steel sheet shape (measured warp shape 21) which is actually measured when the electromagnetic correction is not performed. Accordingly, the target correction shape 20 can be appropriately set according to the actual measured warp shape 21. Therefore, the steel sheet shape at the nozzle position can be flat with high accuracy by correcting the steel sheet 2 to the target correction shape 20 at the electromagnet position.

(2) Method of Using Database

Next, a method of setting the target correction shape 20 using the database 15 without actually measuring the steel sheet shape will be described.

The target shape information, which associates various passing conditions or the disposition of the rolls in the bath such as the IM with the target correction shape 20, is stored in the database 15. The target correction information is information which determines the proper target correction shape 20 for each passing condition and for each roll disposition based on a past operation result or a test result determined by a tester of the continuous hot-dip metal coating apparatus 1. Here, the proper target correction shape 20 is determined so that the amount of warp $d_N$ of the steel sheet shape at the nozzle position is less than the upper limit value $d_{Nmax}$ (for example, 1.0 mm) and the amount of warp $d_R$ of the steel sheet shape in the electromagnet position at the electromagnetic correction is within the predetermined range (for example, 2.0 mm or more, and in the case of the wide steel sheet, 2.0 mm or more and 20 mm or less).

The control device 14 sets the proper target correction shape 20 according to the passing conditions such as the sheet thickness D, the sheet width W, or the tension T set in S100 or the roll disposition set in S102 using the target correction shape information in the database 15. According to this setting method, the target correction shape 20 can be rapidly and easily set without actually measuring the steel sheet shape.

5. CONCLUSION

As described above, the steel sheet shape control apparatus 10 in accordance with the present preferred embodiment and the steel sheet shape control method using the apparatus are described in detail. According to the present preferred embodiment, the shape in the transverse direction Y of the steel sheet 2 at the electromagnet position is not corrected to the flat shape but is positively corrected to the curved shape. At this time, the electromagnetic forces generated by the electromagnets 101 to 107 and 111 to 117 or the disposition of the rolls in the bath such as the 1M are adjusted so that the steel sheet shape at the electromagnet position is the irregular shapes such as the C shape, the W shape, or the zigzag shape in which the amount of warp $d_M$ is 2.0 mm or more, and the steel sheet shape at the nozzle position is a flat shape in which the amount of warp $d_N$ is 1.0 mm or less. Accordingly, the warp in the transverse direction Y of the steel sheet 2 at the nozzle position is decreased, and the steel sheet shape at the nozzle position can be flattened with high accuracy. Therefore, since the hot dip coating can be uniformly wiped in the transverse direction Y of the steel sheet 2 by the wiping nozzles 8 and 8, the coating thickness in the transverse direction Y of the steel sheet 2 can be uniformized.

In addition, by positively curving the shape in the transverse direction Y of the steel sheet 2 at the electromagnet position, the rigidity of the steel sheet 2 conveyed in the transporting direction X can be increased. Accordingly, even when the steel sheet is passed at a high speed, the vibration in the through-thickness direction Z of the steel sheet 2 at the nozzle position can be appropriately suppressed. Therefore, change of the coating thickness in the longitudinal direction (transporting direction X) of the steel sheet 2 is decreased, and thus, the coating thickness in the longitudinal direction can be uniformized.

In addition, in the electromagnetic correction technology of the related art, it is difficult to suppress the vibration having high frequency which is equal to or more than the frequency response of the electromagnet. However, according to the present preferred embodiment, the rigidity is increased by curving the steel sheet 2 at the electromagnet position, and thus, it is also possible to appropriately suppress the vibration having high frequency which is equal to or more than the frequency response of the electromagnet.

Moreover, in the electromagnetic correction technology of the related art, if the steel sheet is tightly held by the electromagnetic force when the vibration of the steel sheet is suppressed by the electromagnetic force generated by the electromagnet, there is a problem that the self-excited vibration, which has the electromagnetic force addition positions as the nodes, occurs in the steel sheet. However, according to the preferred embodiment, when vibration occurs in steel sheet 2, the steel sheet restraining force generated by the electromagnetic force is weakened by decreasing the control gains (particularly, proportional gain $K_p$) of the electromagnets 101 to 107 and 111 to 117, and thus, the vibration of the steel sheet can be appropriately suppressed.

EXAMPLE

Next, Examples of the present invention will be described. Moreover, the following Examples are only examples for confirming that the coating thickness of the steel sheet can be uniformized by the steel sheet shape control of the present invention, and the steel sheet shape control method and the steel sheet shape control apparatus of the present invention are not limited to the following Examples.

Using the continuous hot-dip metal coating apparatus 1 shown in FIG. 2, the coating test of the steel sheet 2 was performed by changing passing conditions (thickness t and width W of the steel sheet 2, Inter Mesh (IM), and the set value of the amount of warp $d_M$ of the target correction shape (W shape) of the steel sheet 2 at the electromagnet position). As the test result, the amount of warp $d_N$ of the steel sheet shape at the nozzle position, the amplitude A of the vibration of the steel sheet 2 at the nozzle position, and the coating amount in the transverse direction Y of the steel sheet 2 were measured. The conditions and result of the test are shown in Table 1.

TABLE 1

Condition and Result of Coating Test

| | Test Condition | | | | Test Result | | |
|---|---|---|---|---|---|---|---|
| | Sheet Thickness t | Sheet Width W | IM | Amount of Warp in Electromagnet Position (Set Value) $d_M$ | Amount of Warp in Nozzle Position (Measured Value) $d_N$ | Amplitude of Vibration of Steel Sheet in Nozzle Position (Measured Value) A | Dispersion of Coating Amount in Through-Thickness Direction |
| Example 1 | 0.75 mm | 900 mm | 30 mm | 5.0 mm | Less than 1.0 mm | Less than 2.0 mm | Less than 10 g/m$^2$ |
| Comparative Example 1 | 0.75 mm | 900 mm | 30 mm | 15.0 mm | 1.0 mm or more | Less than 2.0 mm | 10 g/m$^2$ or more |
| Example 2 | 0.75 mm | 1700 mm | 40 mm | 20 mm | Less than 1.0 mm | Less than 2.0 mm | Less than 10 g/m$^2$ |
| Comparative Example 2 | 0.75 mm | 1700 mm | 40 mm | 25.0 mm | 1.0 mm or more | Less than 2.0 mm | 10 g/m$^2$ or more |
| Example 3 | 0.85 mm | 1700 mm | 10 mm | 2.0 mm | Less than 1.0 mm | Less than 2.0 mm | Less than 10 g/m$^2$ |
| Comparative Example 3 | 0.85 mm | 1700 mm | 10 mm | 1.0 mm | Less than 1.0 mm | 2.0 mm or more | 10 g/m$^2$ or more |

(1) Comparison of Example 1 and Comparative Example 1

As shown in Table 1, in Example 1 of the present invention, when the steel sheet 2 (steel sheet size: sheet thickness 0.75 mm×sheet width 900 mm) was passed, the target correction shape 20 of the steel sheet 2 was set so that the IM=30 mm was satisfied and the amount of warp $d_M$ in the W shape of the steel sheet 2 at the electromagnet position was 5 mm. As a result, the amount of warp $d_N$ of the steel sheet 2 at the nozzle position was less than 1.0 mm, the amplitude A of the vibration of the steel sheet 2 at the nozzle position was less than 2.0 mm, and the dispersion of the coating amount in the transverse direction Y was less than 10 g/m$^2$ so as to be approximately uniform.

On the other hand, in Comparative Example 1, when the steel sheet 2 having the same size as Example 1 was passed under the condition of the IM=30 mm, the target correction shape 20 of the steel sheet 2 was set so that the amount of warp $d_M$ in the W shape of the steel sheet 2 at the electromagnet position was 15 mm. As a result, the amount of warp $d_N$ of the steel sheet 2 at the nozzle position was increased to be 1.0 mm or more, and the amplitude A of the vibration of the steel sheet 2 at the nozzle position was less than 2.0 mm. Accordingly, the dispersion of the coating amount in the transverse direction Y was 10 g/m$^2$ or more.

As understood from the comparison result between Example 1 and Comparative Example 1, when the electromagnetic correction is performed on the steel sheet 2 having the above-described size, if the amount of warp $d_M$ of the target correction shape at the electromagnet position is set to about 5 mm as in Example 1, the amplitude A of the vibration at the nozzle position can be suppressed to be less than 2.0 mm, and since the amount of warp $d_N$ of the steel sheet 2 at the nozzle position can be less than 1.0 mm, the coating thickness in the transverse direction Y can be uniformized. On the other hand, if the amount of warp $d_M$ of the target correction shape at the electromagnet position is set to a large value such as about 15 mm like Comparative Example 1, since the amount of warp $d_N$ of the steel sheet 2 at the nozzle position is increased, it is found that the coating thickness in the transverse direction Y cannot be sufficiently uniformized.

(2) Comparison of Example 2 and Comparative Example 2

As shown in Table 1, in Example 2 of the present invention, when the wide steel sheet 2 (steel sheet size: sheet thickness 0.75 mm×sheet width 1700 mm) was passed, the target correction shape 20 of the steel sheet 2 was set so that the IM=40 mm was satisfied and the amount of warp $d_M$ in the W shape of the steel sheet 2 at the electromagnet position was 20 mm (=the upper limit value $d_{Rmax}$ of the amount of warp $d_R$ of the steel sheet shape at the electromagnet position at the electromagnetic correction). As a result, the amount of warp $d_N$ of the steel sheet 2 at the nozzle position was less than 1.0 mm, the amplitude A of the vibration of the steel sheet 2 at the nozzle position was less than 2.0 mm, the dispersion of the coating amount in the transverse direction Y was less than 10 g/m$^2$, and thus, the coating thickness was substantially uniform in the transverse direction Y.

On the other hand, in Comparative Example 2, when the wide steel sheet 2 having the same size as Example 2 was passed under the condition of the IM=40 mm, the target correction shape 20 of the steel sheet 2 was set so that the amount of warp $d_M$ in the W shape of the steel sheet 2 at the electromagnet position was 25 mm. As a result, the amplitude A of the vibration of the steel sheet 2 at the nozzle position was less than 2.0 mm, the amount of warp $d_N$ of the steel sheet 2 at the nozzle position was increased to be 1.0 mm or more, and accordingly, the dispersion of the coating amount in the transverse direction Y was 10 g/m$^2$ or more, and dispersion occurred in the coating thickness in the transverse direction Y. Moreover, if the amount of warp $d_M$ in the W shape of the steel sheet 2 at the electromagnet position was 25 mm, the wide steel sheet 2 contacted the electromagnets, and a problem in passing of the steel sheet occurred.

As understood from the comparison result between Example 2 and Comparative Example 2, when the electromagnetic correction is performed on the wide steel sheet 2 having the above-described size, if the amount of warp $d_M$ of the target correction shape at the electromagnet position is set to about 20 mm as Example 2, the amount of warp $d_N$ of the steel sheet 2 at the nozzle position is suppressed to be less than 1.0 mm, and the coating thickness in transverse direction Y can be uniformized. On the other hand, if the amount of warp $d_M$ of the target correction shape at the electromagnet position is set to a value which is too large, such as about 25 mm like in Comparative Example 2, the amount of warp $d_N$ of the steel sheet shape at the nozzle position is increased too much and becomes 1.0 mm or more, and it is found that the coating thickness in the transverse direction Y cannot be sufficiently uniformized. Moreover, a problem of the ends of the wide steel sheet 2 contacting the electromagnet also occurs. Accordingly, when the wide steel sheet 2 such as the steel sheet having the sheet width=1700 mm is used, it is preferable that the amount of warp $d_M$ of the target correction shape at the electromagnet position be set to be 20 mm or less so that the amount of warp $d_R$ of the steel sheet 2 at the electromagnet position is 20 mm or less. Accordingly, the wide steel sheet 2 contacting the electromagnet can be avoided.

(3) Comparison of Example 3 and Comparative Example 3

As shown in Table 1, in Example 3 of the present invention, when the wide steel sheet 2 (steel sheet size: sheet thickness 0.85 mm×sheet width 1700 mm) was passed, the target correction shape 20 of the steel sheet 2 was set so that the IM=10 mm was satisfied and the amount of warp $d_M$ in the W shape of the steel sheet 2 at the electromagnet position was 2 mm (=the lower limit value $d_{Rmin}$ of the amount of warp $d_R$ of the steel sheet shape at the electromagnet position at the electromagnetic correction). As a result, the amount of warp $d_N$ of the steel sheet 2 at the nozzle position was less than 1.0 mm, the amplitude A of the vibration of the steel sheet 2 at the nozzle position was less than 2.0 mm, the dispersion of the coating amount in the transverse direction Y was less than 10 g/m$^2$, and thus, the coating thickness was substantially uniform in the transverse direction Y.

On the other hand, in Comparative Example 3, when the wide steel sheet 2 having the same size as Example 3 was passed under the condition of the IM=10 mm, the target correction shape 20 of the steel sheet 2 was set so that the amount of warp $d_M$ in the W shape of the steel sheet 2 at the electromagnet position was 1 mm. As a result, the amount of warp $d_N$ of the steel sheet 2 at the nozzle position was increased to be 1.0 mm or less, but the amplitude A of the vibration of the steel sheet 2 at the nozzle position was increased to be 2.0 mm or more. Accordingly, the dispersion of the coating amount in the longitudinal direction (transporting direction X) of the steel sheet 2 was 10 g/m$^2$ or more.

As understood from the comparison result between Example 3 and Comparative Example 3, when the electromagnetic correction is performed on the wide steel sheet 2 having the above-described size, if the amount of warp $d_M$ of the target correction shape at the electromagnet position is set to 2 mm, which is the lower limit value $d_{Rmin}$ of the amount of warp $d_R$, as Example 3, the amplitude A of the vibration at the nozzle position is suppressed to be less than 2.0 mm, and the coating thickness in the longitudinal direction (transporting direction X) of the steel sheet 2 can be uniformized. On the other hand, if the amount of warp $d_M$ of the target correction shape at the electromagnet position is set to a value which is too small, such as 1 mm like in Comparative Example 3, since the rigidity of the steel sheet 2 is decreased and the steel sheet 2 is easily vibrated, the amplitude A of the vibration at the nozzle position becomes 2.0 mm or more, and thus, it is found that the coating thickness in the longitudinal direction of the steel sheet 2 cannot be sufficiently uniformized. Accordingly, regardless of the width W of the steel sheet 2, it is preferable that the amount of warp $d_M$ of the target correction shape at the electromagnet position be set to be 2.0 mm or more so that the amount of warp $d_R$ of the steel sheet 2 at the electromagnet position is 2.0 mm or more. Therefore, the amplitude A of the vibration of the steel sheet 2 at the nozzle position is suppressed to be less than 2.0 mm, and thus, the coating thickness in the longitudinal direction of the steel sheet 2 can be uniform.

As described above, preferred embodiments of the present invention are described with reference to the accompanying drawings. However, the present invention is not limited to the preferred embodiments. It is obvious that a person ordinarily skilled in the art of the present invention can conceive various alterations and modifications within categories of technical ideas described in claims, and it is understood that various alterations and modifications belong to the technical range of the present invention.

INDUSTRIAL APPLICABILITY

The present invention can be widely used in a steel sheet shape control apparatus and a steel sheet shape control method, the warp and vibration of the steel sheet are suitably suppressed by optimizing the shape in the transverse direction of the steel sheet, and the coating thickness in the transverse direction and the longitudinal direction of the steel sheet can be uniformized.

DESCRIPTION OF THE REFERENCE SYMBOLS

1 continuous hot-dip metal coating apparatus
2 steel sheet
3 coating bath
4 bath
5 sink roll
6, 7 support roll
8 wiping nozzle
10 steel sheet shape control apparatus
11 sensor
12 electromagnet group
13 coating amount measurement device
14 control device
15 database
16 virtual roll
17 virtual roll
18 virtual roll spring
20 target correction shape
21 measured warp shape
22 center line
101, 102, 103, 104, 105, 106, 107 electromagnet
111, 112, 113, 114, 115, 116, 117 electromagnet
121, 122, 123, 124, 125, 126, 127 position sensor
131, 132, 133, 134, 135, 136, 137 position sensor
X transporting direction Y transverse direction
Z through-thickness direction

What is claimed is:

1. A steel sheet shape control apparatus which is provided in a continuous hot-dip metal coating apparatus including a wiping nozzle disposed to be opposite to a steel sheet lifted from a coating bath, and which controls a shape in a transverse direction of the steel sheet by applying an electromagnetic force in a through-thickness direction with respect to the steel sheet, the apparatus comprising:

a plurality of pairs of electromagnets which are disposed along the transverse direction in both sides in the through-thickness direction of the steel sheet above the wiping nozzle;

a control device which controls the electromagnet;

rolls which are provided in the coating bath and which includes at least a pair of support rolls between which a steel sheet moves and which contact the steel sheet conveyed to a vertical upper side; and a plurality of pairs of second sensors which are disposed along the transverse direction in both sides in the through-thickness direction of the steel sheet at the position of the electromagnet, and measure the position in the through-thickness direction of the steel sheet, wherein the control device is configured to:

(A) set a target correction shape in the transverse direction of the steel sheet at a position of the electromagnet to a curved shape by performing a first numerical analysis based on a passing condition of the steel sheet, (B) measure the shape in the transverse direction of the steel sheet at a predetermined position between the wiping nozzle and the electromagnet or measures coating amount of the hot-dip metal with respect to the steel sheet at the subsequent stage of the electromagnet position when the steel sheet is conveyed in a state where the electromagnetic force is applied to the steel sheet by the electromagnet so that the shape in the transverse direction of the steel sheet at the position of the electromagnet is the curved shape set in (A), (C) calculate the shape in the transverse direction of the steel sheet at the position of the wiping nozzle based on the shape or the coating amount measured in (B), (D) repeat (B) and (C) by adjusting the target correction shape to a curved shape having an amount of warp different from the curved shape set in (A) by performing the first numerical analysis when the amount of warp of the shape calculated in (C) is equal to or more than a first upper limit value, (E) measure vibration in the through-thickness direction of the steel sheet at the predetermined position when the amount of warp of the shape calculated in (C) is less than the first upper limit value, (F) calculate vibration in the through-thickness direction of the steel sheet at the position of the wiping nozzle by performing a second numerical analysis based on the vibration measured in (E), and (G) adjust a control gain of the electromagnet by performing the second numerical analysis to make amplitude of the vibration calculated in (F) be less than a second upper limit value when the amplitude is equal to or more than the second upper limit value, wherein the control device is configured to, when the target correction shape is set in (A), (A1) measure the position in the through-thickness direction of the steel sheet at the position of the electromagnet by the second sensor when the steel sheet is conveyed in a state where the electromagnetic force is not applied by the electromagnet, (A2) calculate a warp shape in the transverse direction of the steel sheet at the position of the electromagnet in the state where the electromagnetic force is not applied by the electromagnet, based on the position measured in (A1), and (A3) set the target correction shape to a curved shape which is symmetrical in the through-thickness direction to the warp shape calculated in (A2), and wherein in (A) and (D), the control device is configured to adjust a pushing-in amount of the steel sheet by the pair of support rolls so that the amount of warp of the shape in the transverse direction of the steel sheet at the position of the electromagnet, in the state where the electromagnetic force is applied, is 2.0 mm or more.

2. The steel sheet shape control apparatus according to claim 1, further comprising:

one or more first sensors which are disposed to be opposite to the steel sheet above the wiping nozzle and below the electromagnet, and measure the position in the through-thickness direction of the steel sheet, wherein the control device in (B), measures the shape in the transverse direction of the steel sheet at the position of the first sensor by the first sensor in the state where the electromagnetic force is applied to the steel sheet by the electromagnet, and in (E), measures vibration in the through-thickness direction of the steel sheet at the position of the first sensor by the first sensor when the amount of warp of the shape calculated in (C) is less than the first upper limit value.

3. The steel sheet shape control apparatus according to claim 1, wherein the control device, when the target correction shape is set in (A), sets the target correction shape in the transverse direction of the steel sheet by the electromagnet for each passing condition using a predetermined database so that the range of amount of warp of the shape in the transverse direction of the steel sheet at the position of the electromagnet, in the state where the electromagnetic force is applied, is 2.0 mm or more and the amount of warp of the shape in the transverse direction of the steel sheet at the position of the wiping nozzle is less than the first upper limit value in the state where the electromagnetic force is applied.

4. The steel sheet shape control apparatus according to claim 1, wherein the control device, in (D), adjusts disposition of the rolls provided in the coating bath so that the range of amount of warp of the shape in the transverse direction of the steel sheet at the position of the electromagnet, in the state where the electromagnetic force is applied, is 2.0 mm or more and the amount of warp of the shape in the transverse direction of the steel sheet at the position of the wiping nozzle is less than the first upper limit value in the state where the electromagnetic force is applied.

5. The steel sheet shape control apparatus according to claim 4, wherein the roll includes a sink roll which converts the conveyed direction of the steel sheet to the vertical upper side, and the pair of support rolls are provided above the sink roll, and wherein the control device, in (D), adjusts the pushing-in amount of the steel sheet by the pair of support rolls so that the amount of warp of the shape in the transverse direction of the steel sheet at the position of the wiping nozzle is less than the first upper limit value in the state where the electromagnetic force is applied.

6. The steel sheet shape control apparatus according to claim 1, wherein the control device, in (D), repeats (B) and (C) by resetting the target correction shape to a curved shape having the amount of warp smaller than that of the curved shape set in (A) when the amount of warp of the shape calculated in (C) is equal to or more than the first upper limit value or when the range of amount of warp of the warp shape in the transverse direction of the steel sheet at the position of the electromagnet, in the state where the electromagnetic force is applied, is 2.0 mm or more.

7. The steel sheet shape control apparatus according to claim 1, wherein a control system of the electromagnet is a PID control, and wherein in (G), the amplitude is controlled by decreasing a proportional gain of a proportional operation of the PID control as the control gain.

8. The steel sheet shape control apparatus according to claim 1, wherein the first upper limit value is 1.0 mm, and the second upper limit value is 2.0 mm.

* * * * *